US007520551B2

(12) United States Patent
Lambarth et al.

(10) Patent No.: US 7,520,551 B2
(45) Date of Patent: Apr. 21, 2009

(54) METHOD OF LOADING AN AMBULANCE COT INTO AN AMBULANCE

(75) Inventors: Clifford E. Lambarth, Portage, MI (US); Christopher B. Way, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 12/156,852

(22) Filed: Jun. 5, 2008

(65) Prior Publication Data

US 2008/0240901 A1 Oct. 2, 2008

Related U.S. Application Data

(62) Division of application No. 10/542,232, filed as application No. PCT/US2004/001070 on Jan. 14, 2004, now Pat. No. 7,478,855.

(60) Provisional application No. 60/440,209, filed on Jan. 15, 2003.

(51) Int. Cl.
*A61G 1/02* (2006.01)

(52) U.S. Cl. ..... 296/20; 296/19

(58) Field of Classification Search ..... 296/20, 296/19; 5/625, 620, 86.1, 626, 627; 410/66
See application file for complete search history.

(56) References Cited

U.S. PATENT DOCUMENTS

| | | | | |
|---|---|---|---|---|
| 3,759,565 | A * | 9/1973 | Ferneau | 296/20 |
| 3,831,996 | A * | 8/1974 | Layer | 296/19 |
| 4,097,941 | A * | 7/1978 | Merkel | 295/20 |
| 4,273,374 | A * | 6/1981 | Portman | 296/19 |
| 5,365,622 | A * | 11/1994 | Schirmer | 5/611 |
| 5,537,700 | A * | 7/1996 | Way et al. | 296/20 |
| 5,740,884 | A | 4/1998 | DiMucci et al. | |
| 5,779,296 | A * | 7/1998 | Hewko | 296/19 |
| 6,219,864 | B1 * | 4/2001 | Ellis et al. | 5/611 |
| 6,276,010 | B1 * | 8/2001 | Way et al. | 5/611 |
| 6,332,638 | B1 * | 12/2001 | Menna | 296/20 |
| 6,890,137 | B2 * | 5/2005 | Hillberry et al. | 296/20 |
| 2005/0120480 | A1 * | 6/2005 | Benedict et al. | 5/611 |
| 2007/0000057 | A1 * | 1/2007 | Ward | 296/20 |
| 2007/0169269 | A1 * | 7/2007 | Wells | 296/20 |
| 2008/0001421 | A1 * | 1/2008 | Matunaga et al. | 296/20 |
| 2008/0005842 | A1 * | 1/2008 | Schrand et al. | 5/620 |

FOREIGN PATENT DOCUMENTS

| | | |
|---|---|---|
| GB | 2 203 999 A | 11/1988 |
| WO | WO 01/01913 A1 | 1/2001 |
| WO | WO 02/00466 A1 | 1/2002 |

* cited by examiner

*Primary Examiner*—Kiran B. Patel
(74) *Attorney, Agent, or Firm*—Flynn, Thiel, Boutell & Tanis, P.C.

(57) ABSTRACT

An ambulance cot loading and unloading device which utilizes an elongate guide track configured for mounting to a floor surface of a cargo area on the ambulance. A trolley is supported for movement relative to the guide track and has an elongate boom. The ambulance cot has a powered collapsible and extendable base and a patient support deck mounted on the base. A connection mechanism is provided on the trolley and the ambulance cot which is configured to interconnect and securely hold the ambulance cot on the trolley.

4 Claims, 24 Drawing Sheets

Power Load system installed

Power Load system installed and lowered

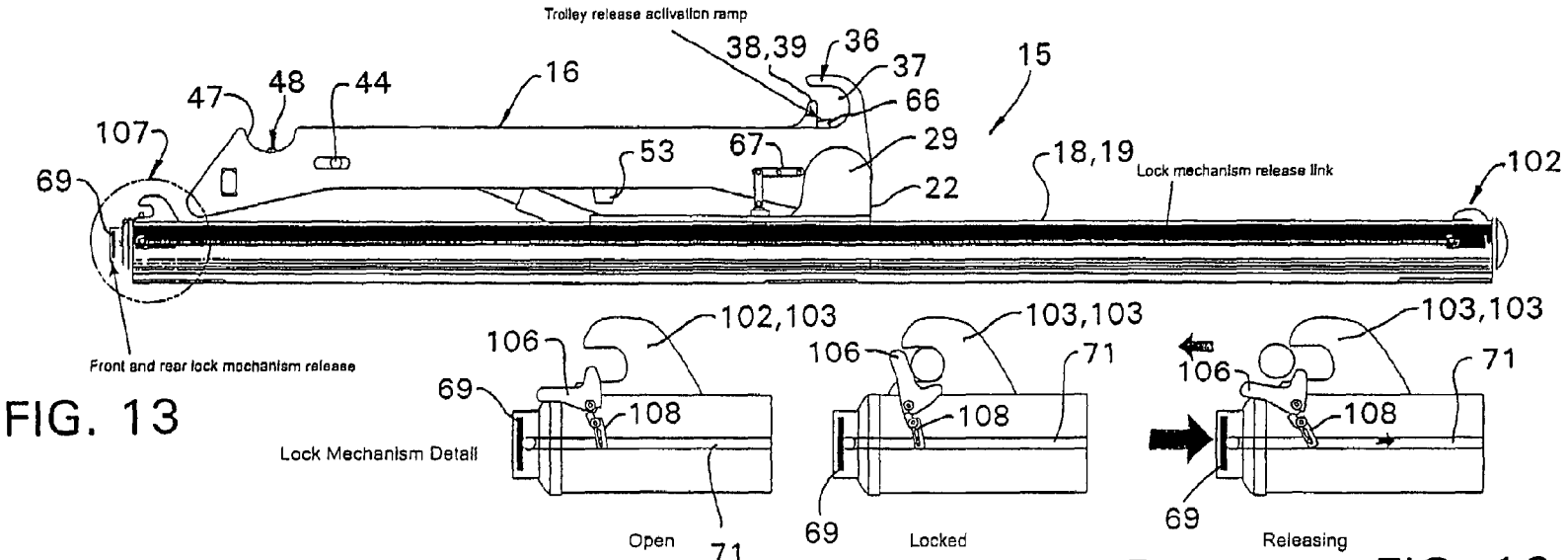
FIG. 13
FIG. 14
FIG. 15
FIG. 16
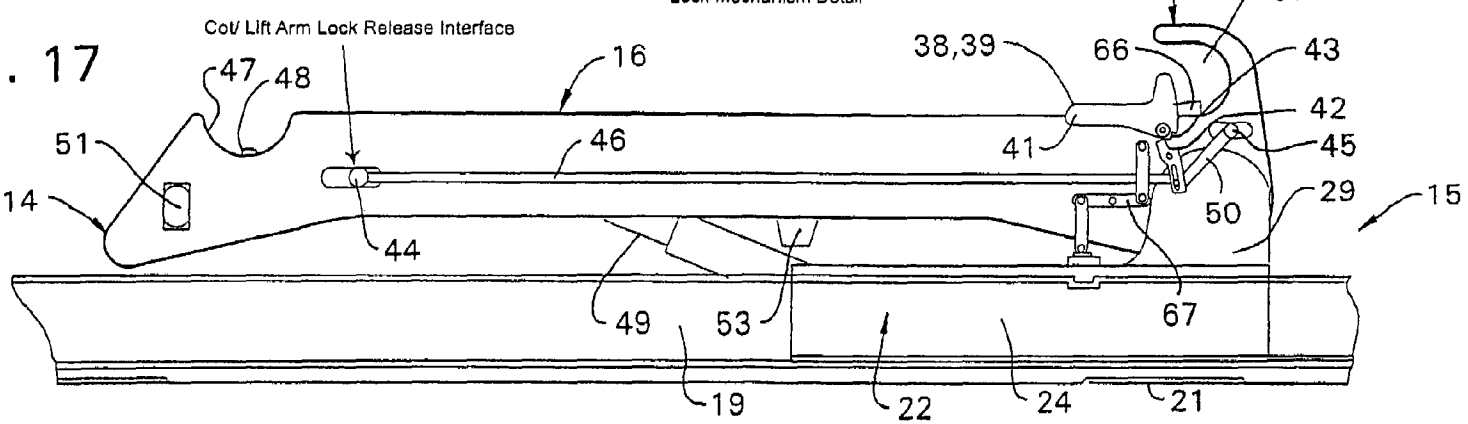
FIG. 17

Loading Sequence

METHOD OF LOADING AN AMBULANCE COT INTO AN AMBULANCE

CROSS REFERENCE TO RELATED APPLICATIONS

This application is a division of U.S. application Ser. No. 10/542,232, filed Jul. 14, 2005, now U.S. Pat. No. 7,478,855, which is a 35 USC 371 nationalization of PCT Application No. PCT/US2004/001070, filed Jan. 14, 2004, which international application published in English, and which international application claims the priority of U.S. Provisional Application No. 60/440 209, filed Jan. 15, 2003.

FIELD OF THE INVENTION

This invention relates to an ambulance cot loading and unloading device and methodology, as well as an ambulance cot support arrangement, especially suitable for ambulances.

BACKGROUND OF THE INVENTION

Emergency medical service (EMS) personnel are required to handle the combined weight of a patient and the ambulance cot during various stages of insertion of the ambulance cot into the cargo area of an ambulance. In some instances, the head end of the ambulance cot needs to be lifted by a first EMS attendant for insertion into the cargo area so that the head end wheels become supported on the floor surface of the cargo area as the base construction for the ambulance cot is collapsed thereby necessitating a second EMS attendant to lift the combined weight of the ambulance cot and patient at the foot end of the ambulance cot during the completion of an insertion of the ambulance cot into the cargo area. The same requirement exists when the ambulance cot with a patient thereon is removed from the cargo area. In some instances, there exists a risk of back injury to the EMS personnel as a result of this lifting and insertion as well as removal methodology. In addition, there is a risk of injury to the patient on the ambulance cot when an EMS attendant is injured and is no longer able to support the ambulance cot and the patient thereon when the ambulance cot is spaced above the ground during insertion or removal thereof from the cargo area. Accordingly, it is advantageous to provide an ambulance cot loading and unloading device as well as methodology for accomplishing same as well as providing an ambulance cot support arrangement in the ambulance which will minimize the likelihood of injury to the patient during transport.

SUMMARY OF THE INVENTION

The objects and purposes of the invention are met by providing an ambulance cot loading and unloading device which utilizes an elongate guide track configured for mounting to a floor surface of a cargo area on the ambulance. A trolley is supported on the elongate guide track for movement relative to the guide track. The trolley is configured to extend to a location outside of the cargo area when the trolley is in a first position and additionally configured to be housed entirely inside the cargo area when the trolley is not in the first position. The ambulance cot has a collapsible and extendable base and a patient support deck mounted on the base. A connection mechanism is provided on the trolley and the ambulance cot which is configured to interconnect and securely hold the ambulance cot on the trolley.

BRIEF DESCRIPTION OF THE DRAWINGS

Other objects and purposes of this invention will be apparent to persons acquainted with apparatus of this general type upon reading the following specification and inspecting the accompanying drawings in which:

FIG. 13 is a schematic side illustration of the ambulance cot loading and unloading device;

FIG. 14 is an illustration of the encircled area of FIG. 13;

FIG. 15 is like FIG. 14, but with a locking device shifted to the locked position;

FIG. 16 is a view like FIG. 15, but with the locking device shifted to the unlocked position;

FIG. 17 is a schematic side illustration of the trolley and elongate boom;

DETAILED DESCRIPTION

Figure 1:
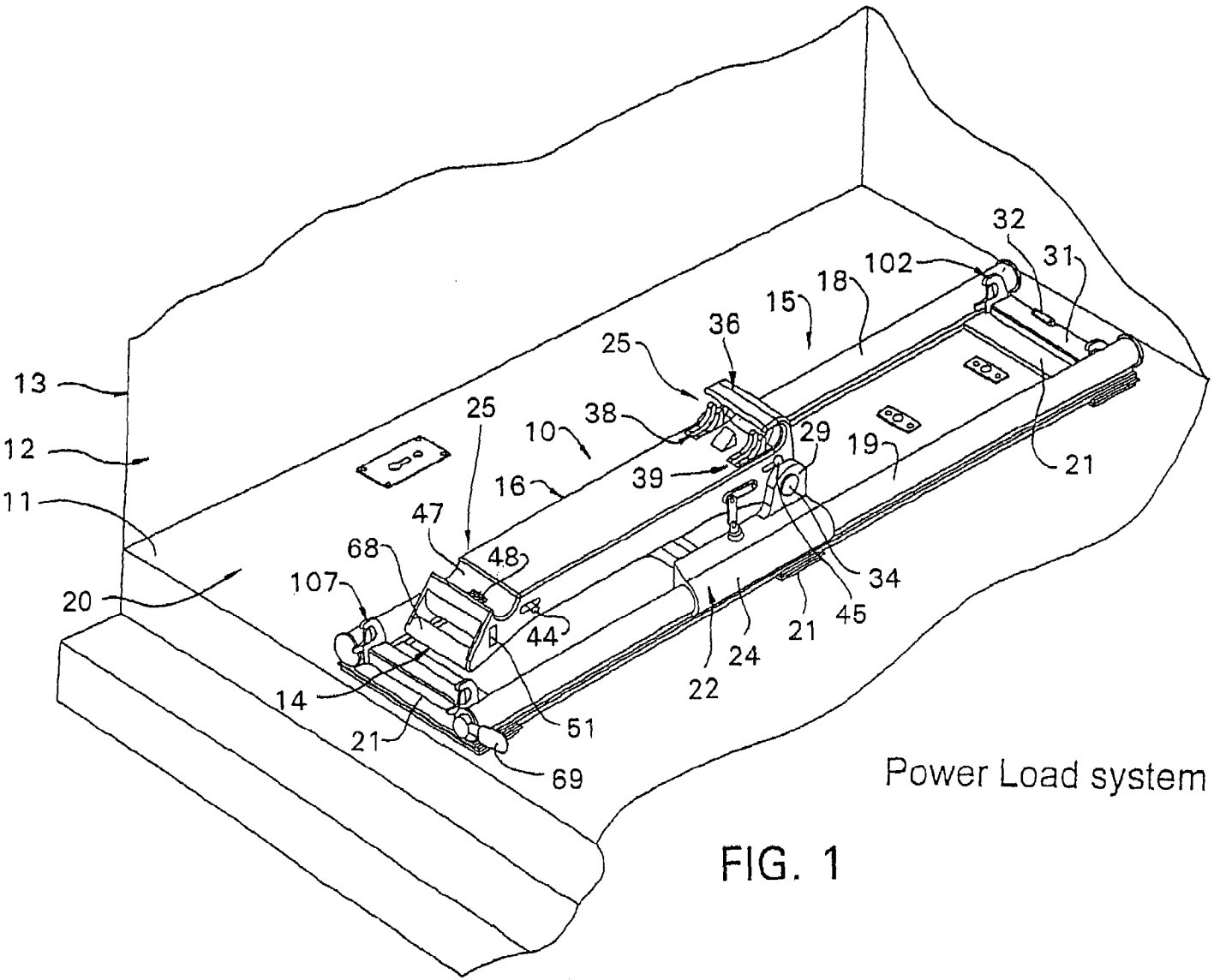
FIG. 1 is an isometric view of the interior of a cargo area of an ambulance with an ambulance cot loading and unloading device embodying the invention being incorporated therein.
Figure 2:
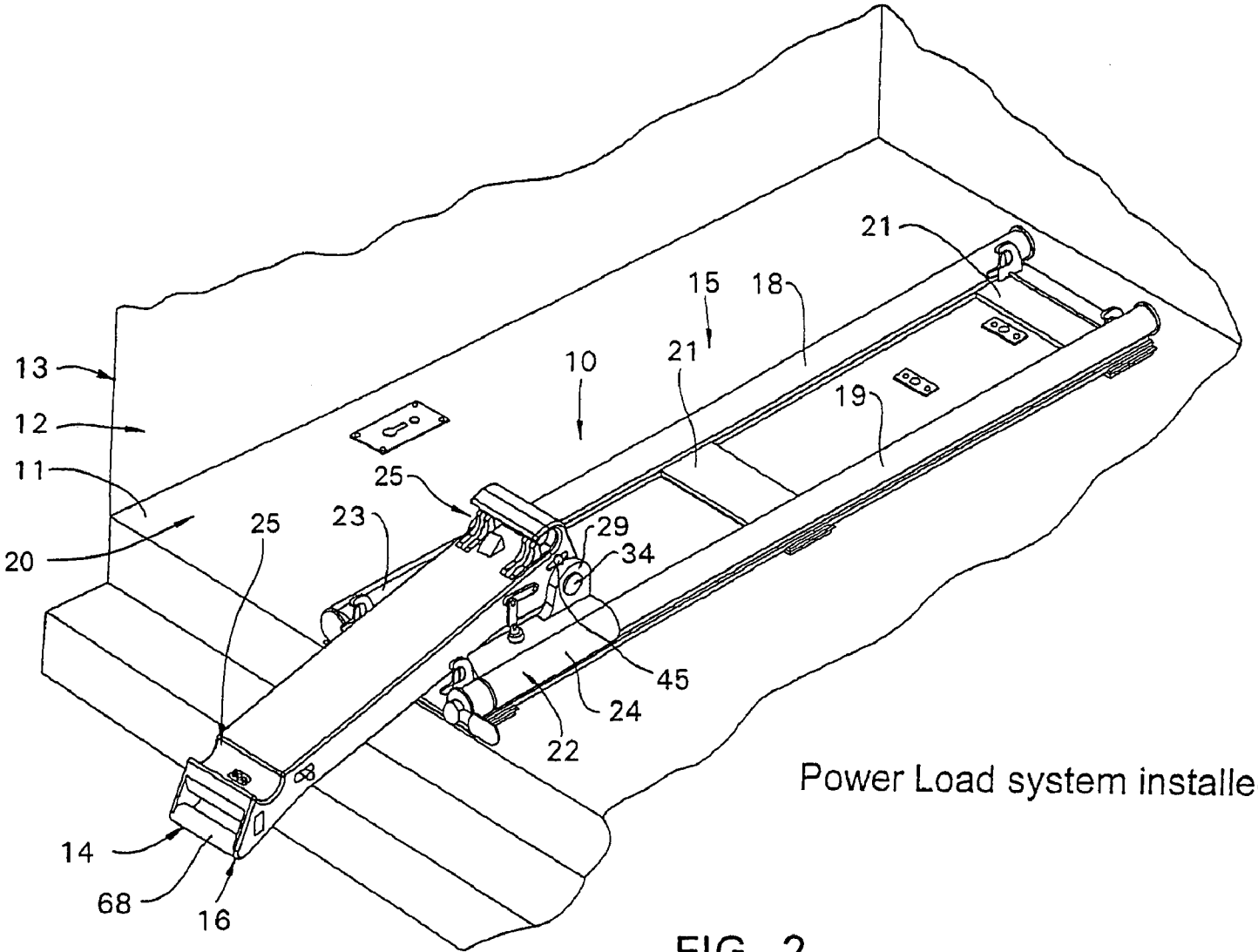
FIG. 2 is a view similar to FIG. 1, but with the ambulance cot loading and unloading device shifted from a stowed position in the interior of the cargo area as shown in FIG. 1 to a deployed position.
Figure 3:
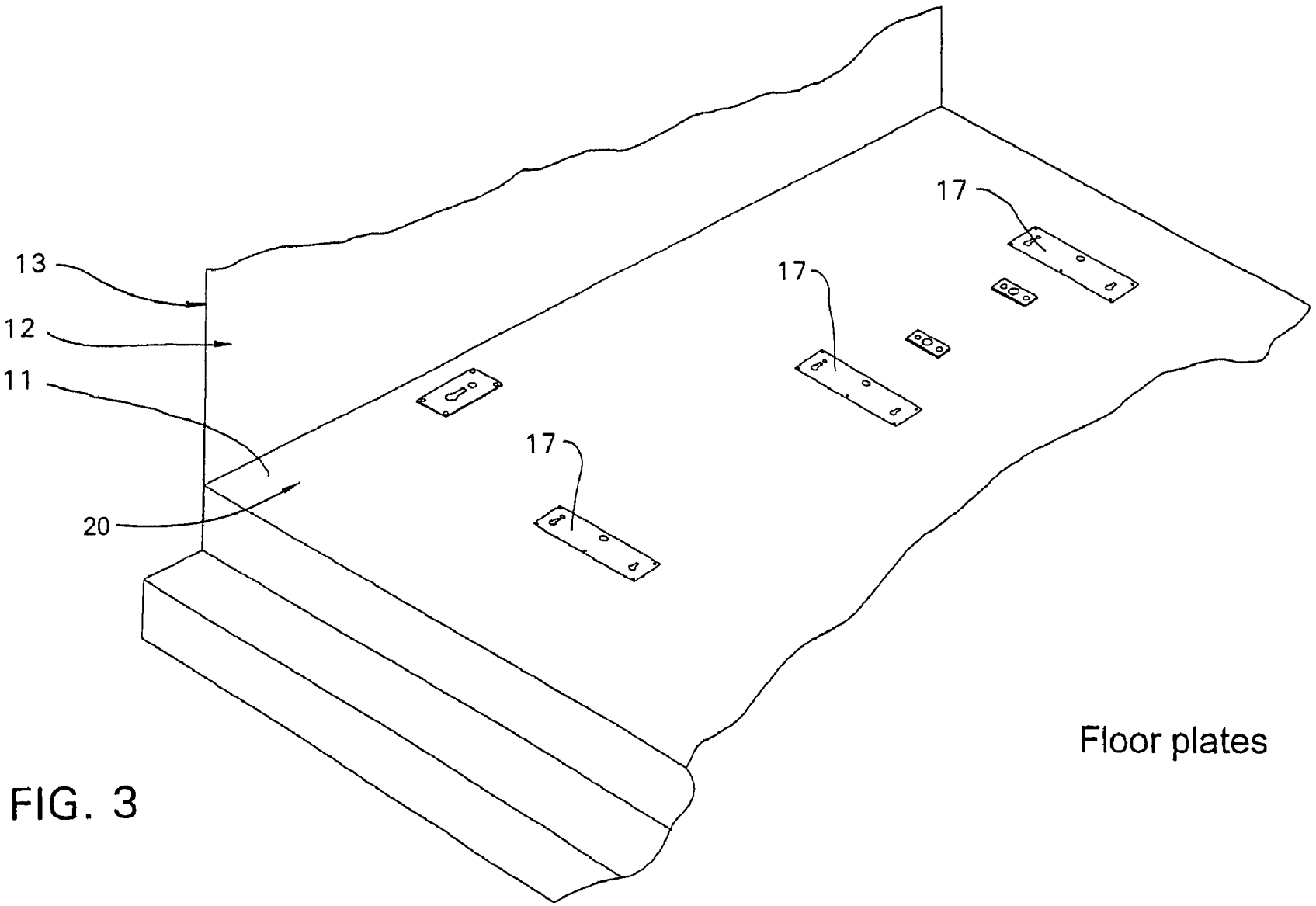
FIG. 3 is a view similar to FIG. 1, but with the ambulance cot loading and unloading device removed.

FIGS. 1 and 2 are both an isometric view of an ambulance cot loading and unloading device 10 embodying the invention and oriented on the floor surface 11 of a cargo area 12 of an ambulance 13. FIG. 2 illustrates the ambulance cot loading and unloading device in a deployed position wherein a distal end 14 of an elongate boom 16, having an ambulance cot docking structure 25 thereon, extends out of an access opening 20 to the cargo area 12 to a location outside of the cargo area 12. Inside a conventional cargo area 12 there is provided a plurality of floor mounted plates 17 (FIG. 3). These plates are provided almost in a standard array in every cargo area of an ambulance so that the inventive ambulance cot loading and unloading device 10 can interface therewith.

More specifically, the ambulance cot loading and unloading device 10 includes an elongate guide track 15 consisting of a pair of elongate and parallel guide tubes 18 and 19 having a plurality of mounting plates interconnecting the guide tubes at multiple locations along the lengths thereof. The mounting plates 21 are spaced apart at an interval equal to the spacing between the floor plates 17 illustrated in FIG. 3 so that the mounting plates 21 can be utilized to secure the guide tubes 18 and 19 to the floor 11.

Figure 12:
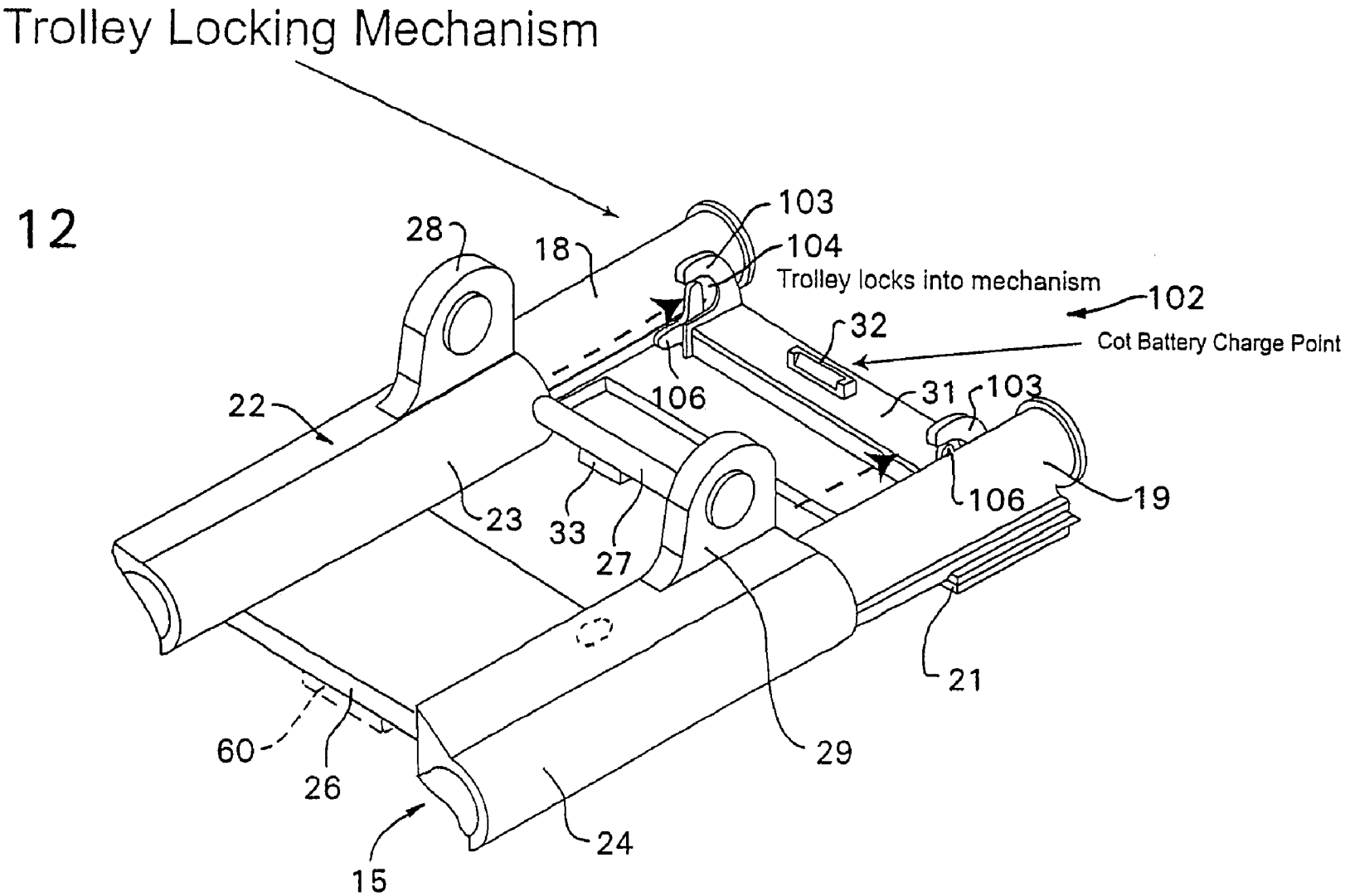
FIG. 12 is a fragment of the interior-most end of the ambulance cot loading and unloading device.
Figure 19:
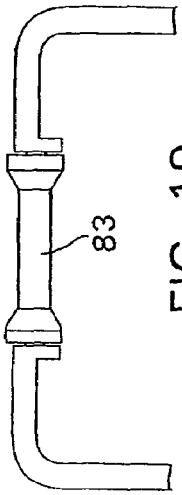
FIG. 19 is a top illustration of a head end of the ambulance cot.
Figure 20:
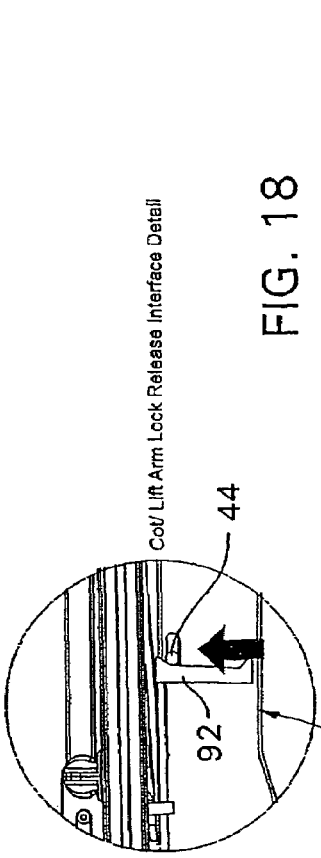
FIG. 20 is a enlarged detail of an operative link between the ambulance cot and the trolley.

The ambulance cot loading and unloading device 10 includes a trolley 22 that is movable along the length of the guide tubes 18 and 19. The trolley includes a pair of tubular sleeves 23 and 24 respectively telescoped over the guide tubes 18 and 19 and a plate 26 (FIG. 12) interconnecting the sleeves 23 and 24 together. A locking bar 27 is also connected to and extends between the sleeves 23 and 24 as is also illustrated in FIG. 12. The trolley 22 also has a pair of upstanding bearing blocks 28 and 29 provided on the sleeves 23 and 24, respectively.

The rightmost mounting plate 21 in FIG. 1 includes a plate 31 having an electrical connector 32 centrally mounted thereon, the electrical connector 32 being connected to an electrical system onboard the ambulance at a location beneath the floor plate 17. An electrical connector 33 is centrally provided on the locking bar 27 and is configured to mate with the electrical connector 32 when the trolley 22 reaches a location at the rightmost end of the guide tubes 18 and 19.

The elongate boom 16 is pivotally secured at one end to the bearing blocks 28 and 29 by any convenient structure providing an axle therefor. The axle has been generally indicated by the reference numeral 34. The elongate boom includes at the end thereof adjacent the axle 34 one part of a two part ambulance cot docking structure 25 in the form of an upstanding hook-like configuration 36 wherein the opening into the hook-like configuration opens in a direction toward the distal end 14 of the elongate boom 16. Within the interior 37 of the hook-like configuration 36 there is provided two sets of toggle locking members 38 and 39, also shown in FIG. 17. Each of the set of toggle levers 38, and 39 are pivotally mounted on the elongate boom 16 and are configured to move in a manner suggested by FIGS. 14, 15 and 16. Each of the toggle levers 38 and 39 includes a torsion spring (not shown) urging the toggle levers 38 and 39 to the position illustrated in FIGS. 1 and 17. When an object is moved into the interior 37 of the hook-like configuration 36, as will be explained in more detail below, each of the toggle levers 38 and 39 will rotate counterclockwise so that the long legs 41 thereof will move to an upstanding position against the urging of the torsion spring. A latch 42 will move into a notch 43 provided on each toggle lever 38 and 39 to hold the long leg 41 in an upstanding position to block the exit of the object. A first manually engageable handle 44 is connected to the latch 42 by means of an elongate linkage 46 to facilitate a movement of the latch so that it is removable from the notch 43 to enable the torsion spring to return each of the toggle levers 38 and 39 to the position illustrated in FIG. 17. A second manually engageable handle 45 is linked by a linkage member 50 (FIG. 17) to the elongate linkage 46 to provide a second location from which to facilitate a movement of the latch 42 so that it is removed from the notch 43 to enable the torsion spring to return each of the toggle levers 38 and 39 to the position illustrated in FIG. 17.

Adjacent the distal end 14 of the elongate boom 16 there is provided the other part of the ambulance cot docking structure 25 in the form of a depression 47 in which there is provided a set of electrical contacts 48. The electrical contacts 48 are electrically connected to the electrical contact 33 described above. The functionality of the set of electrical contacts 48 will be described in more detail below.

Figure 11:
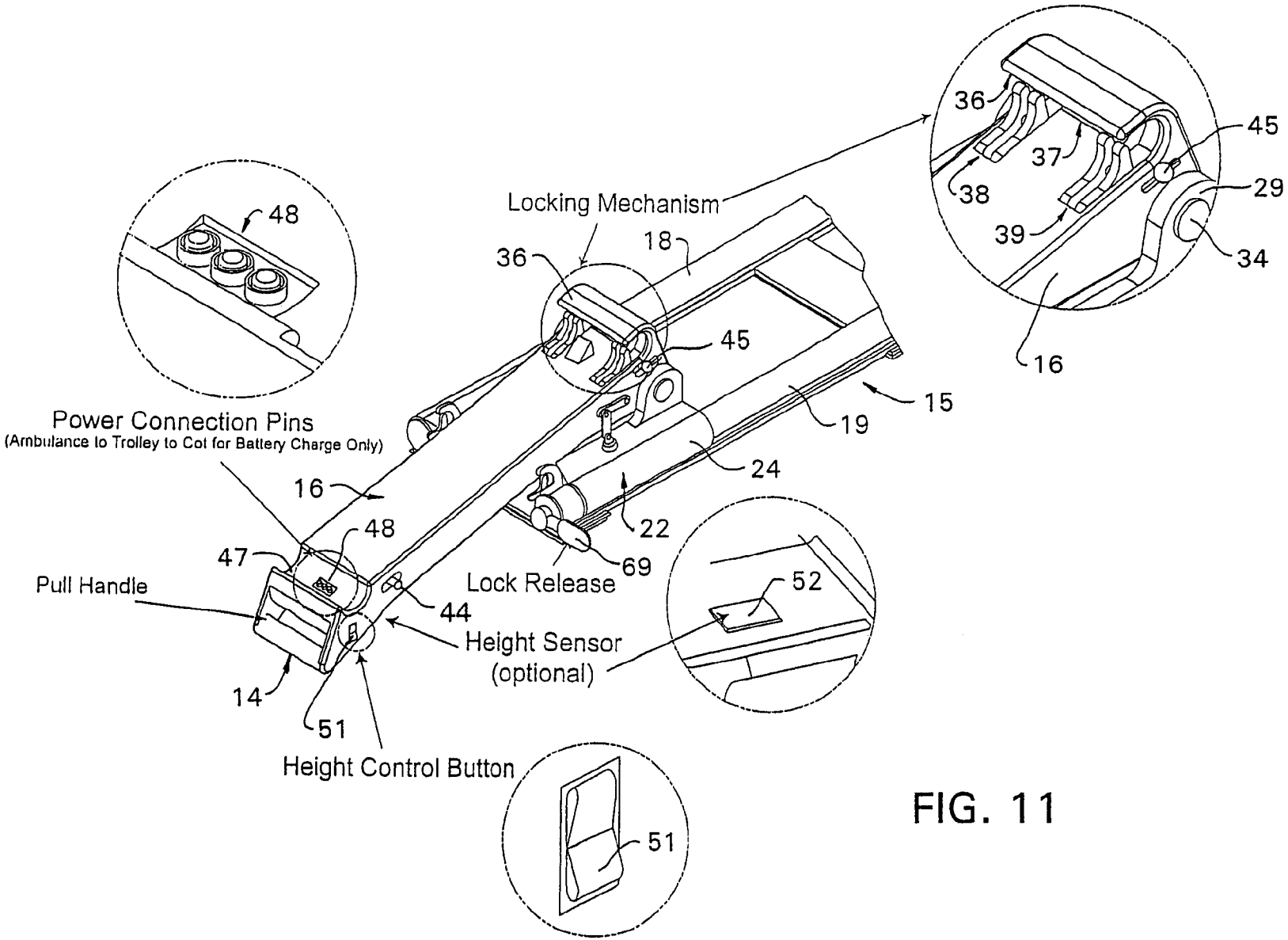
FIG. 11 is an isometric view of a fragment of the ambulance cot loading and unloading device with the trolley and elongate boom thereon located in the deployed position.

The elongate boom 16 is pivotal about the axle 34. An electrical jack mechanism 49 is connected to and extends between the plate 26 and the underside of the elongate boom 16. The electrical jack mechanism 49 is extendable and contractible to effect a pivotal movement of the elongate boom in a manner that will be readily understood by those skilled in the art. A toggle switch 51 is mounted adjacent the distal end 14 and, upon manipulation, effects an extension or contraction of the jack mechanism 49 through the electrical connection provided between the switch 51 and a drive motor for the jack mechanism 49. If desired, an optional height sensor 52 (FIG. 11) can be provided on the elongate boom 16 adjacent the distal end 14 so as to provide an indication of the distance between the underside of the elongate boom 16 and the ground surface.

Figure 4:
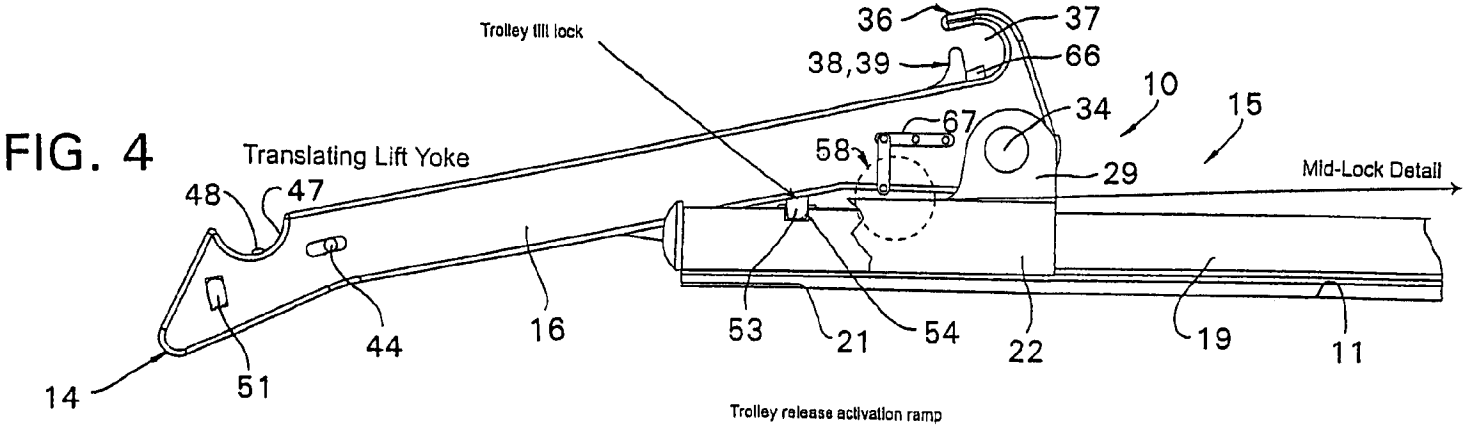
FIG. 4 is a schematic side illustration of the ambulance cot loading and unloading device in a deployed position thereof.

A lug 53 is provided on the underside of the elongate boom 16 and is configured to be received into a receptacle 54 provided on the elongate guide track 15 defined by the guide tubes 18 and 19. It is desirable to orient the receptacle 54 on a mounting plate 21 so that upon reception of a lug 53 therein when the elongate boom 16 is lowered to the FIG. 4 position, the trolley 22 will be incapable of movement relative to the elongate guide tubes 18 and 19. Upon a raising of the elongate boom 16 to the position illustrated in FIG. 17, the lug 53 will be removed from the receptacle 54 to facilitate manual displacement of the trolley 22 along the length of the guide tubes 23 and 24.

In this particular embodiment, there is no drive mechanism for powering the trolley 22 along the length of the guide tubes 18 and 19. However, it is conceivable that such a drive mechanism could be provided and such is to be included within the scope of this invention.

Figure 10:
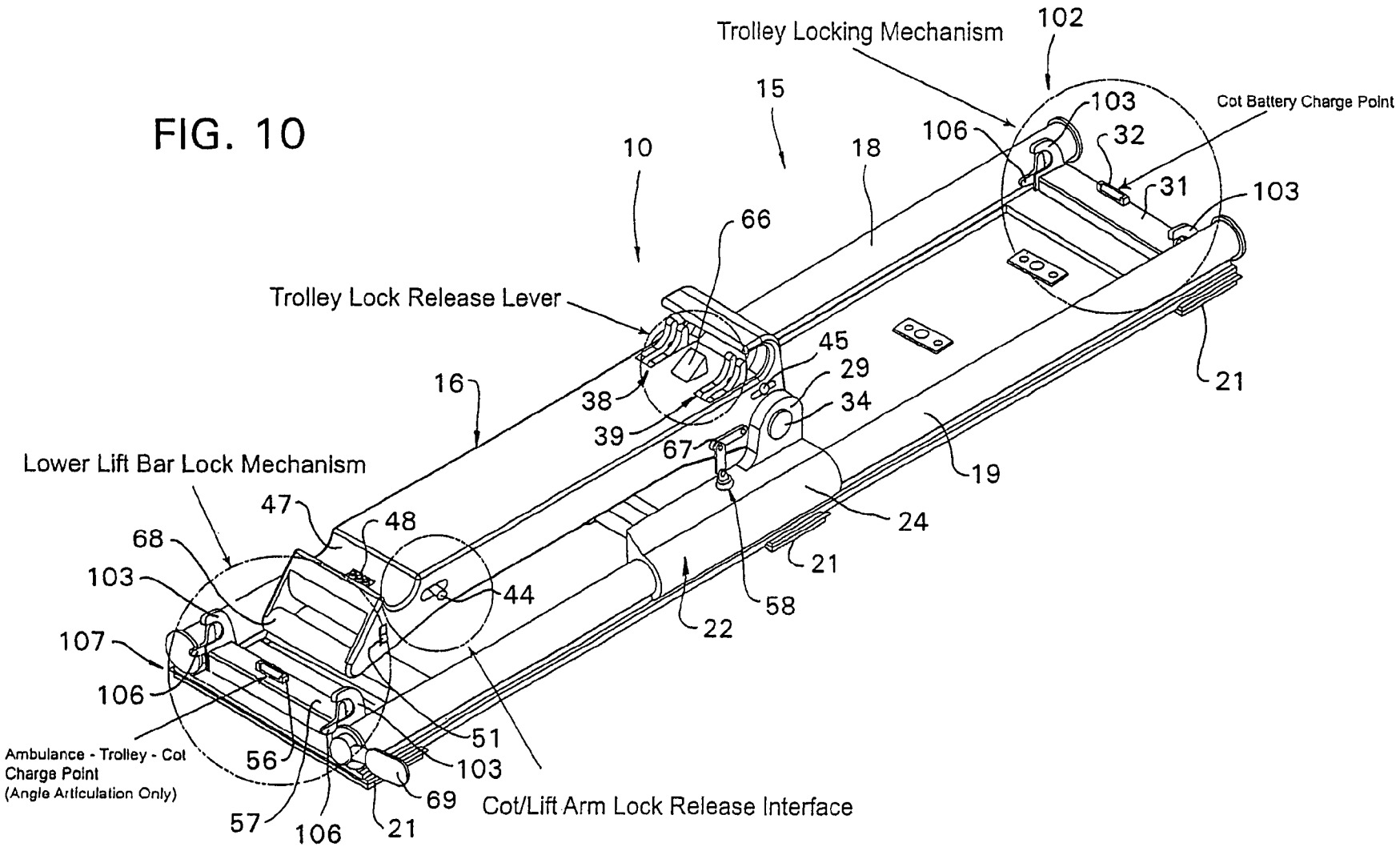
FIG. 10 is an isometric view of the ambulance cot loading and unloading device in the stowed position.

As illustrated in FIG. 10, there is provided a centrally disposed electrical connector 56 on a mounting plate 57 oriented at an end of the guide track 15 remote from the electrical connector 32. The electrical connector 56 is connected to the onboard electrical system of the ambulance. When the trolley 22 is in the position illustrated in FIG. 10, there is no electrical power being supplied to it. As a result, operation of the toggle switch 51 will not effect an operation of the jack mechanism 49. On the other hand, when the trolley 22 is moved leftwardly, there is provided an electrical connector 60 (FIG. 12) on the trolley 22 which engages the electrical connector 56 so that electrical energy is supplied to the toggle switch 51 to effect a reverse in polarity of the drive motor for the jack mechanism 49 and to effect a corresponding raising and lowering of the elongate boom 16 only when the elongate boom is in the deployed position illustrated in FIGS. 2 and 11.

Figure 7:
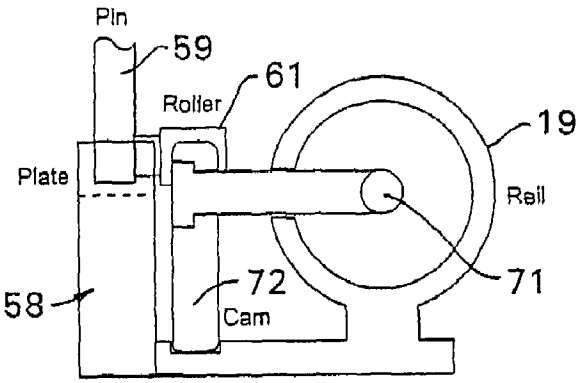
FIG. 7 is a schematic sectional view of the encircled area identified in broken lines in FIG. 4.
Figure 8:
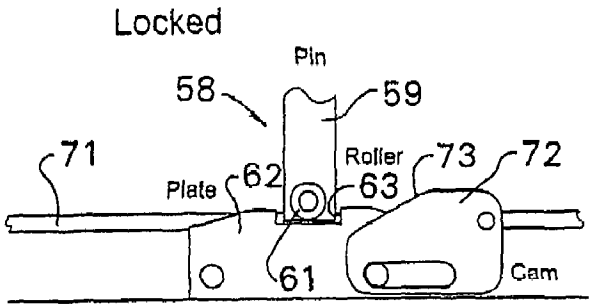
FIG. 8 is a side view of FIG. 7 and illustrating a locking pin in a locked position.
Figure 9:
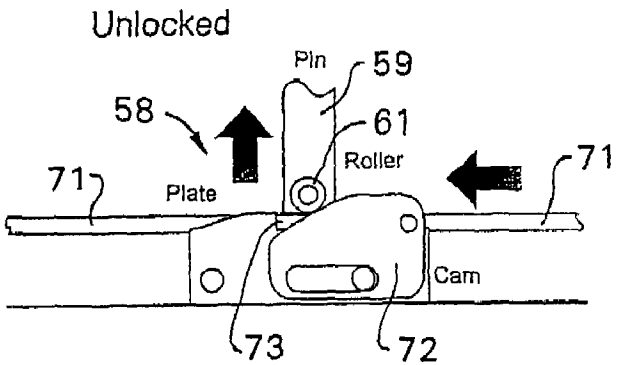
FIG. 9 is a view like FIG. 8, but with the locking pin shifted to the unlocked position.

When the trolley 22 is in the FIG. 10 position, it is normally locked to the elongate guide track 15 defined by the guide tubes 18 and 19. A locking mechanism 58 therefor is depicted in detail in FIGS. 5, 6, 7, 8 and 9. The locking mechanism 58 includes a pin 59 (FIG. 8) which is supported for vertical movement. The pin includes a roller 61 rotatably secured to the bottom end of the pin 59. A plate 62 having a notch 63 therein is secured to the elongate guide track, such as to one of the mounting plates 21 so that the pin 59 can be moved vertically into and out of the notch 63. When the pin 59 is received in the notch 63 as depicted in FIG. 8, the trolley 22 will be incapable of movement due to the interconnection of the pin 59 on the trolley to the guide track.

Figure 6:
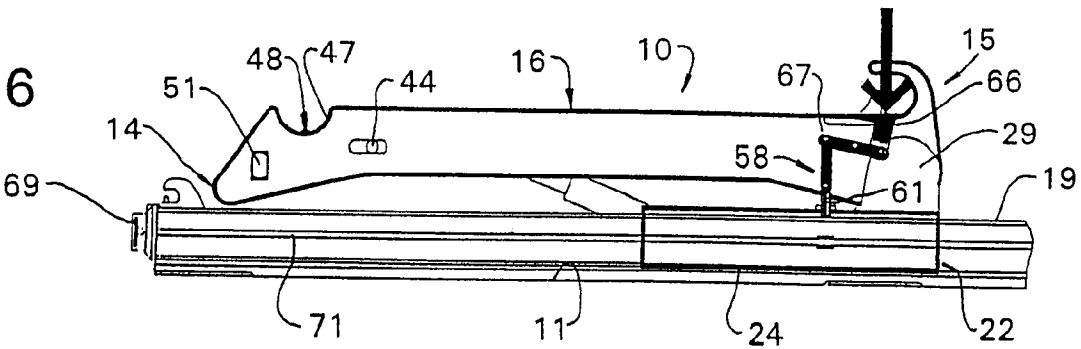
FIG. 6 is a schematic side illustration similar to FIG. 5, but in an unlocked condition.

An object detector 66 is oriented in the interior 37 of the hook-like configuration 36 on the elongate boom 16. When an object is present in the interior 37, the object detector 36 will be articulated downwardly as depicted in FIG. 6. A linkage mechanism 67 is provided to effect a lifting of the pin 61 out of the notch 63 when the object detector 66 is moved to the FIG. 6 position. On the other hand, when the trolley 22 is oriented intermediate the ends of the elongate guide track defined by the guide tubes 18 and 19, namely, is in the position illustrated in FIG. 10, and no object is present in the interior 37 of the hook-like configuration 36, the pin will effect a locking of the trolley 22 in position so that the vehicle can be in motion without there being any corresponding inadvertent movement of the trolley relative to the elongate guide track 15.

Figure 5:
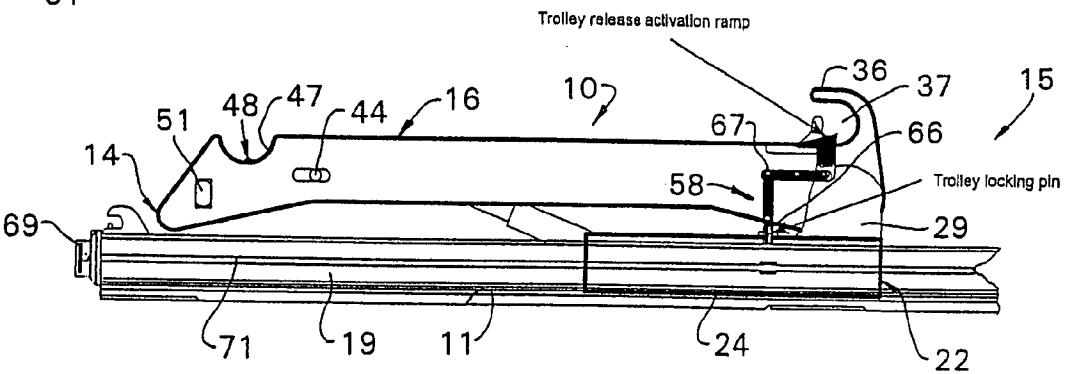
FIG. 5 is a schematic side view of the ambulance cot loading and unloading device in a stowed and locked position inside the cargo area of the ambulance.

When it is desired to move the trolley 22 leftwardly from the FIG. 1 position to the FIG. 2 position, the operator will grasp a handle configuration 68 to enable the elongate boom 16 to be easily grasped and pulled in a direction leftwardly in FIG. 2 to draw the trolley 22 to the FIG. 2 position. However, and before the trolley can be so moved, a removal of the locking pin 59 from the notch 63 is required. This is accomplished by manipulating a handle 69 oriented at the left end of the guide tube 16 as illustrated in FIG. 10. The handle 69 is connected to an elongate rod 71 that extends through the interior of the guide tube 19 as depicted in FIGS. 5, 6 and 7. The elongate rod 71 spring centered and is connected to a cam having an inclined cam surface 73 thereon facing the roller 61. Thus, as the handle 69 is pulled leftwardly, the elongate rod 71 will be pulled leftwardly against a spring urging to bring the cam surface 73 into engagement with the roller 61 to cause the roller 61 to roll up the ramp-like inclination 73 to draw the pin 59 from the notch 63.

Figure 18:
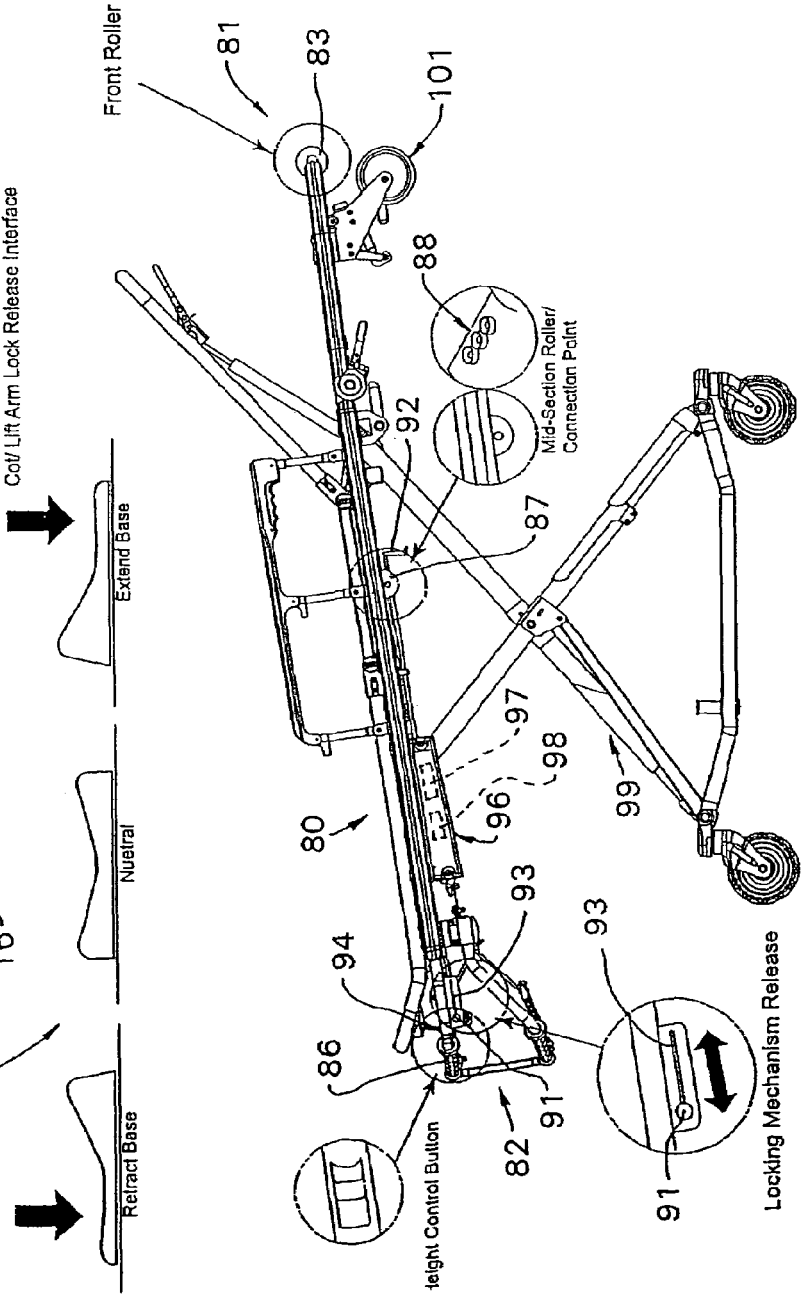
FIG. 18 is a side illustration of an ambulance cot embodying the invention.
Figures 28, 29:
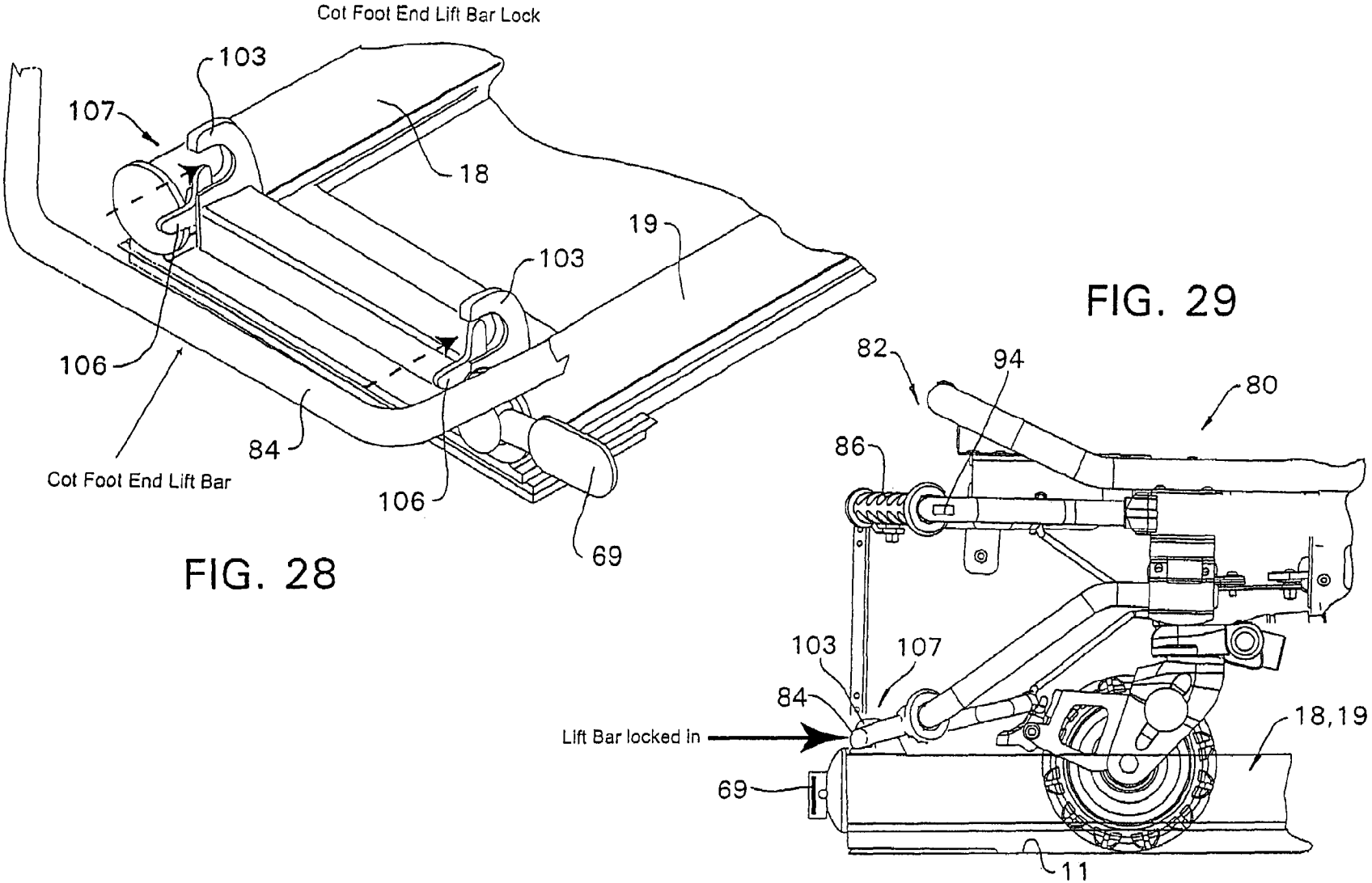
FIG. 28 is an enlarged isometric of one end of the elongate guide track and the associated structure at the foot end of the ambulance cot.
FIG. 29 is an enlarged side view of the operatively engaged elongate track and foot end of the ambulance cot.

An ambulance cot 80 (FIG. 18) is configured to operatively load and unload from the ambulance cot loading and unloading device 10 described above. The particular construction of the ambulance cot 80 is disclosed in detail in U.S. Pat. No. 5,537,700 and the subject matter thereof is incorporated herein by reference. The ambulance cot 80 described in the aforesaid patent has been modified at both the head end 81 and the foot end 82 of the patient support deck frame 79 and as described below. More specifically, the head end 81 has been modified to include a roller 83 rotatably mounted on an axis of rotation that extends perpendicular to a longitudinal axis of the ambulance cot 80. At the foot end 82, the auxiliary handle described in the aforementioned patent has been reconfigured as a foot end lift bar 84 (FIGS. 28 and 29) and additional hand grips 86 have been operatively connected to the foot end 82 of the ambulance cot 80 to facilitate attendant handling of the ambulance cot.

The support deck frame 79 of the ambulance cot 80 has been further modified to include a midsection connection piece 87 (FIG. 18) having a set of electrical contacts 88 thereon configured to interconnect with the set of electrical contacts 48 on the elongate boom 16. The connection 87 is also configured to snugly nest into the depression 87 in which the electrical contacts 48 is provided.

The support deck frame 79 of the ambulance cot 80 has been further modified to include a handle 91 (FIG. 18) interconnected by a linkage (not shown) to an abutment 92 oriented adjacent the connection 87. The abutment 92 is configured to engage the handle 44 on the elongate boom in response to manual manipulation of the handle 91. In this particular embodiment, the handle 91 is reciprocally supported in an elongate slot 93 provided at the foot end 82 of the ambulance cot 80 so that upon reciprocation of the handle 91 in the slot 93, the abutment 92 will also reciprocate to effect movement of the handle 44.

The ambulance cot 80 has been further modified to include a handle 91 interconnected by a linkage (not shown) to an abutment 92 oriented adjacent the connection 87. The abutment 92 is configured to engage the handle 44 on the elongate boom in response to manual manipulation of the handle 91. In this particular embodiment, the handle 91 is reciprocally supported in an elongate slot 93 provided at the foot end 82 of the ambulance cot 80 so that upon reciprocation of the handle 91 in the slot 93, the abutment 92 will also reciprocate to effect movement of the handle 44.

Figure 21:
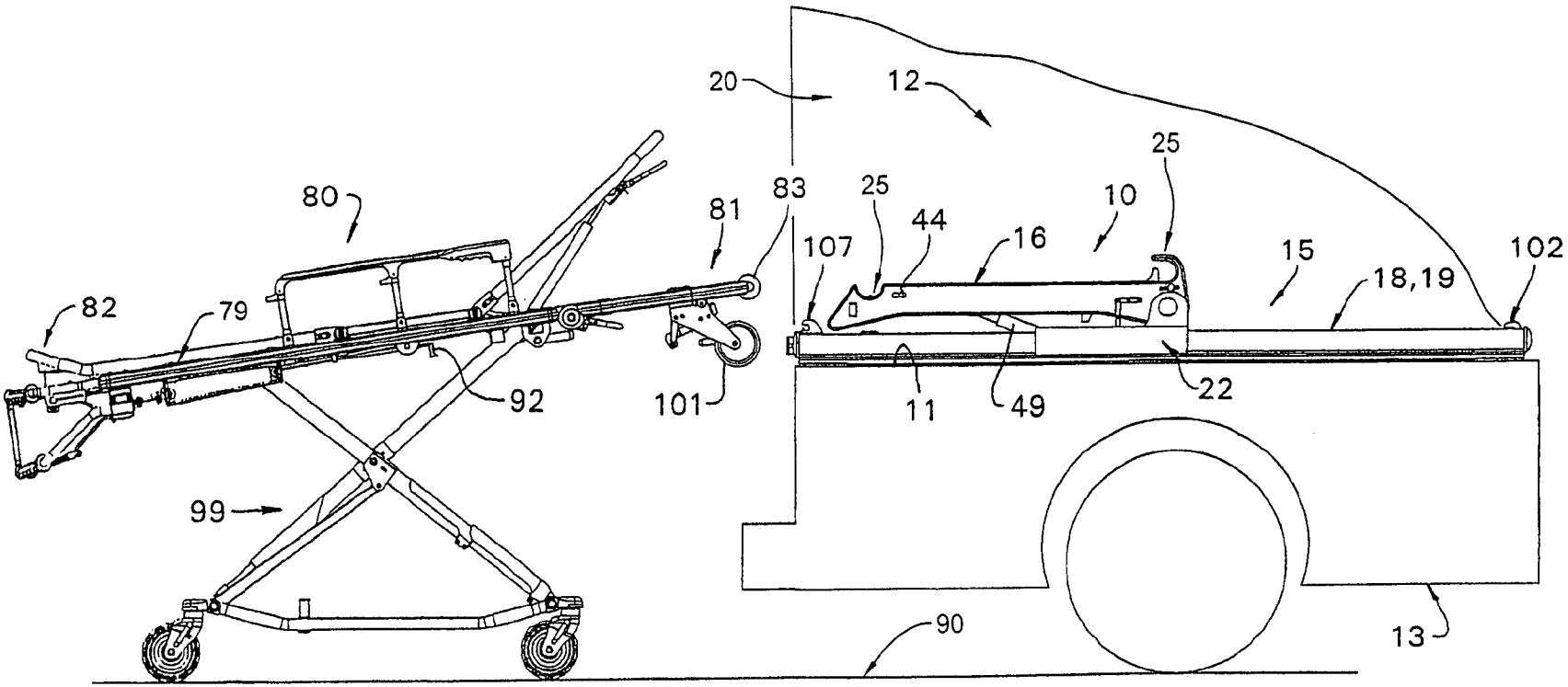
FIG. 21 is a schematic illustration of the start of an ambulance cot loading sequence.
Figure 22:
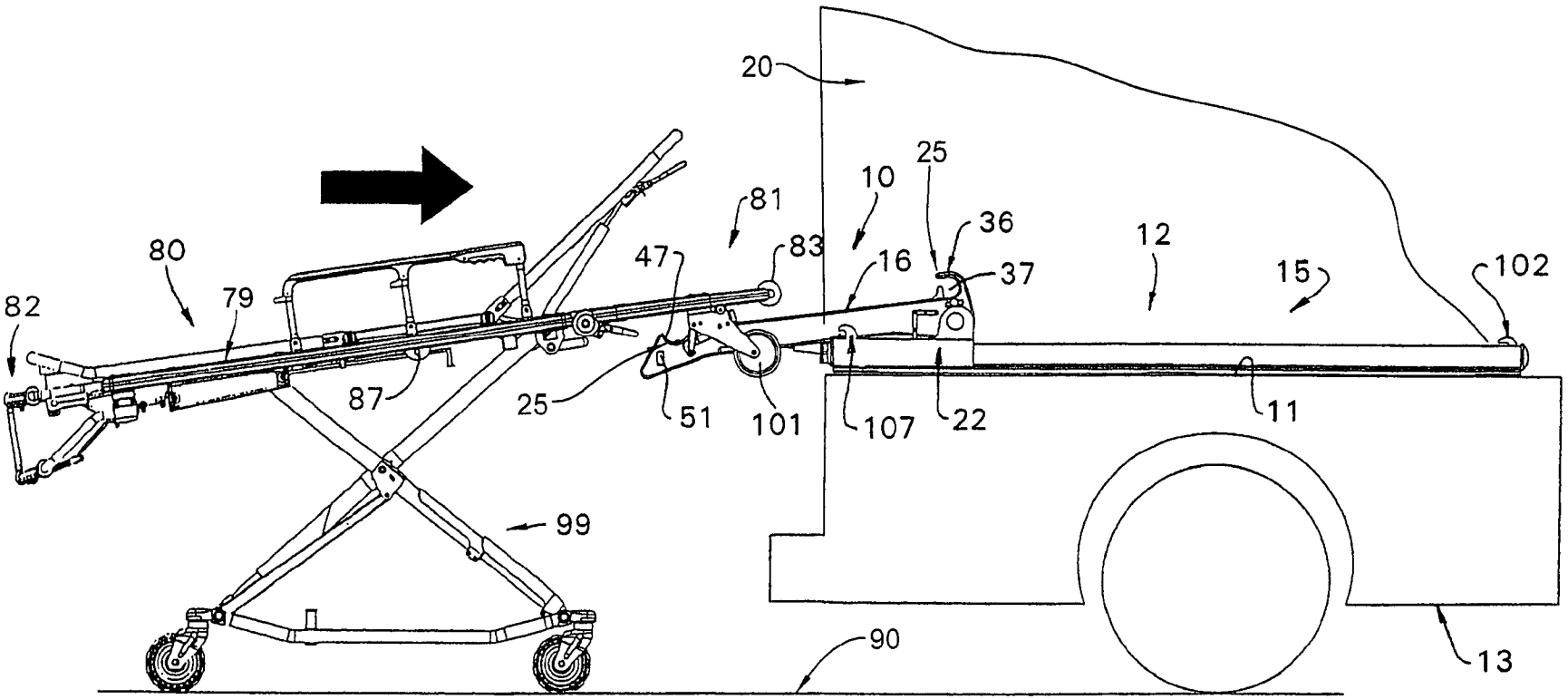
FIG. 22 is a view similar to FIG. 21, but with the trolley and elongate boom thereon moved to the deployed or load position ready to accept the ambulance cot thereon.

Turning now to FIG. 21, when it is desired to load the ambulance cot 80 through the access opening 20 into the cargo area 12 of an ambulance 13, it is necessary for the ambulance cot loading and unloading device 10 to be deployed so that the distal end 14 of the elongate boom 16 extends rearwardly through the access opening 20 from the cargo area and is lowered as depicted in FIG. 22. The aforesaid operation is accomplished by an attendant pulling the handle 69 in a rearward direction to cause the handle to impart a rearward movement of the elongate rod 71 as well as the cam 72 (FIGS. 8 and 9) to cause the inclined surface 73 on the cam 72 to engage the roller 61 to impart an upward lifting movement of the pin 59 from the notch 63. This operation unlocks the trolley 22 from the elongate guide track. Thereafter, the attendant can grasp the handle 68 at the distal end 14 of the elongate boom 16 to impart a rearward movement to the trolley 22 so that it shifts its location from the position inside the cargo area 12 illustrated in FIG. 21 to the position illustrated in FIG. 22 wherein it extends outwardly through the access opening 20. In the position illustrated in FIG. 22, the electrical contact 60 on the trolley 22 (FIG. 12) will interconnect with the electrical connector 56 so that electrical power from the ambulance 13 will be supplied to the toggle switch 51 to enable operative control to be provided to the electric motor for the jack mechanism 49 so as to facilitate an extension or retraction of the jack mechanism 49 to thereby effect a raising or a lowering of the elongate boom 16 relative to the trolley 22. Since, as depicted in FIG. 22, it is desired to load the ambulance cot 80 into the cargo area 12 of the ambulance 13, the toggle switch 51 will effect a lowering of the elongate boom 16 to a location wherein the lug 53 enters the receptacle 54 on the elongate guide track to effectively lock and hold the trolley 22 in place while the ambulance cot 80 is being loaded.

Figure 23:
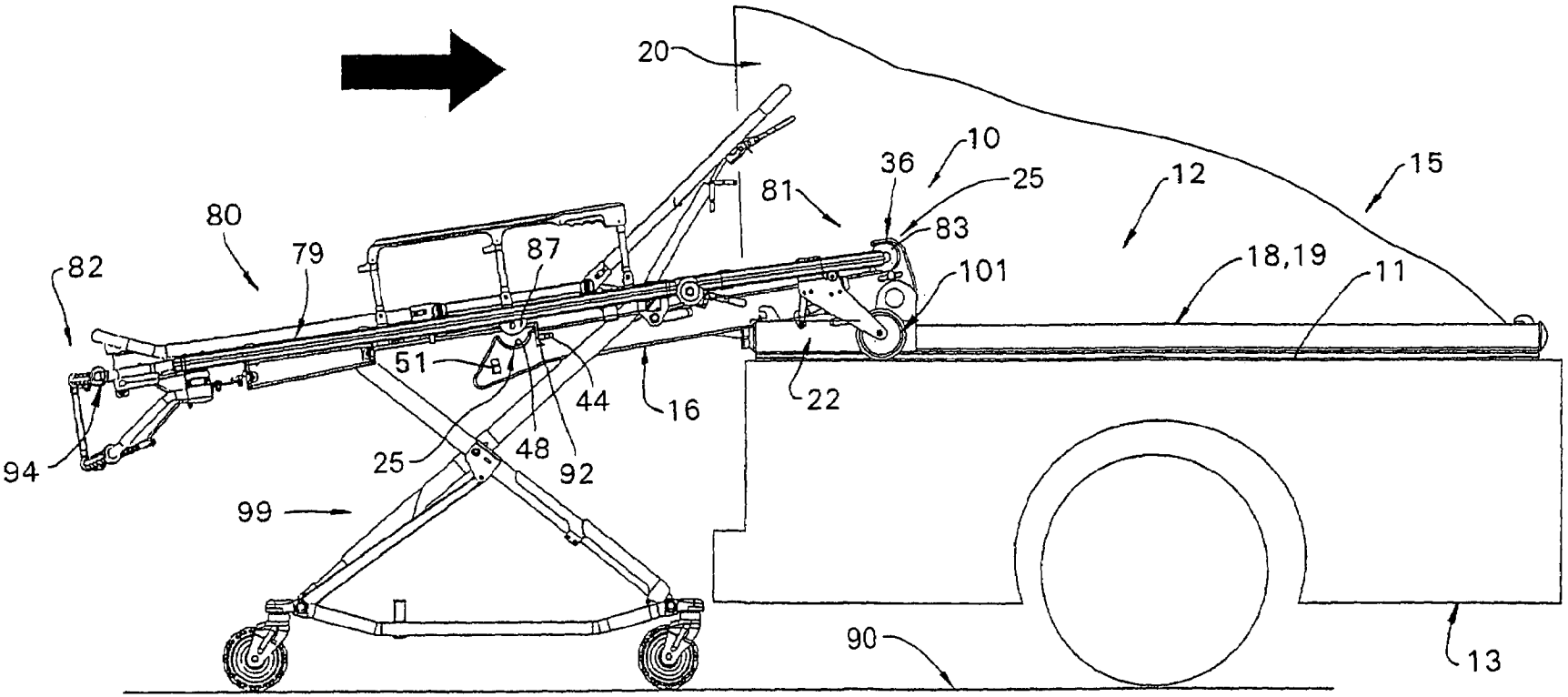
FIG. 23 is a view similar to FIG. 22, but with the ambulance cot engaged with the trolley.
Figure 24:
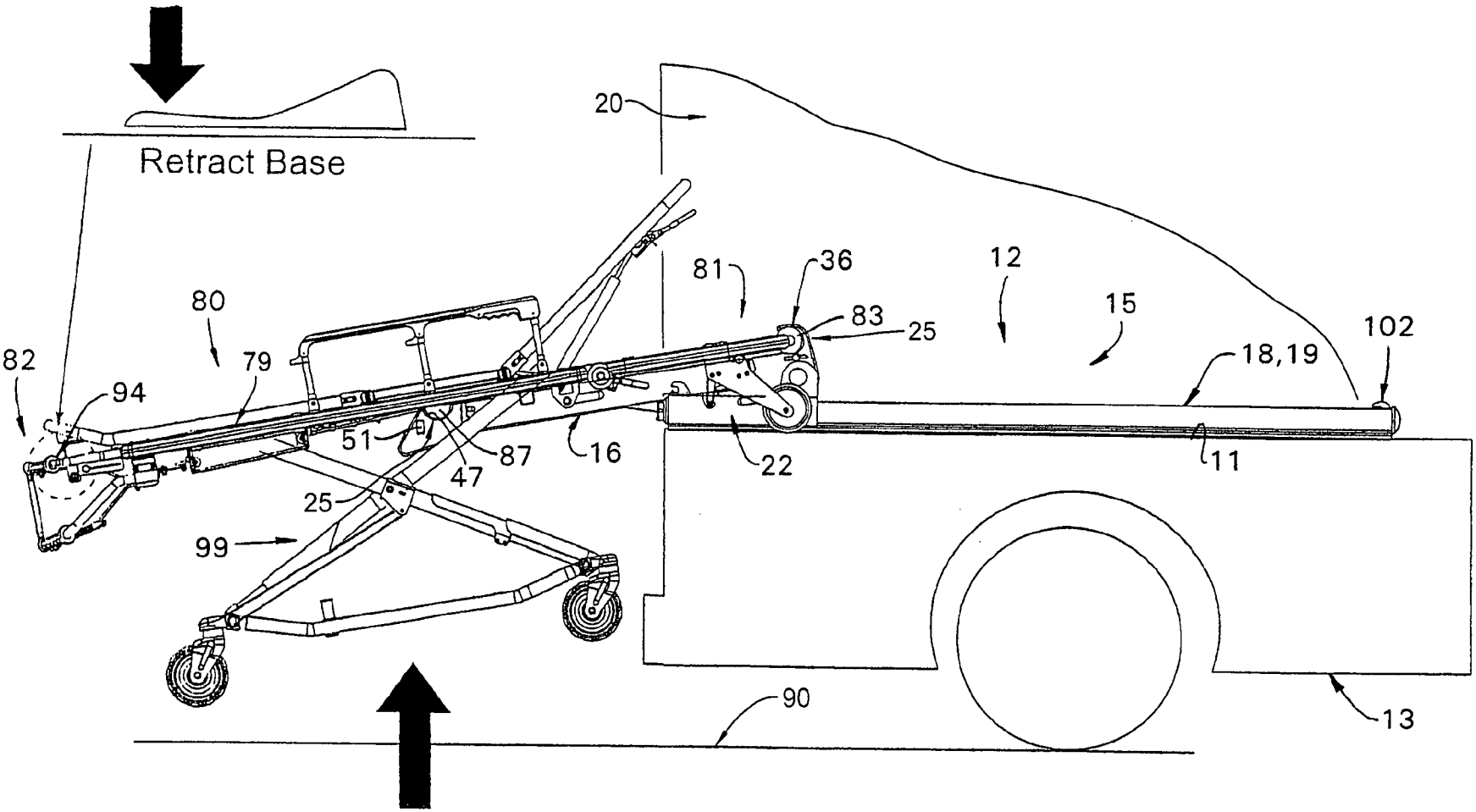
FIG. 24 is a view similar to FIG. 23, but with the ambulance cot supported entirely on the trolley and associated elongate boom.
Figure 25:
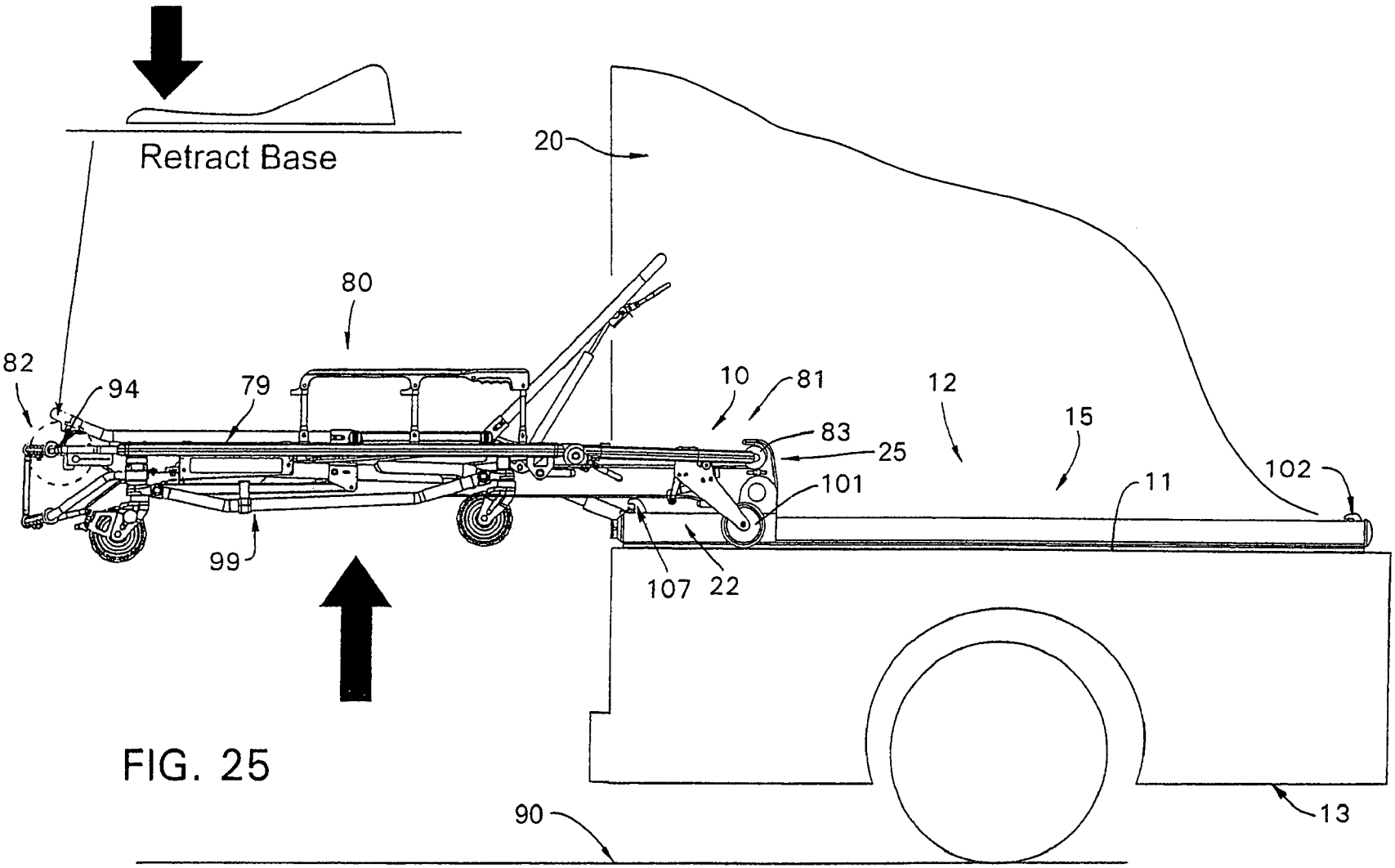
FIG. 25 is a view similar to FIG. 24, but with the ambulance cot base shifted to a position ready for insertion into the cargo area of the ambulance.
Figure 26:
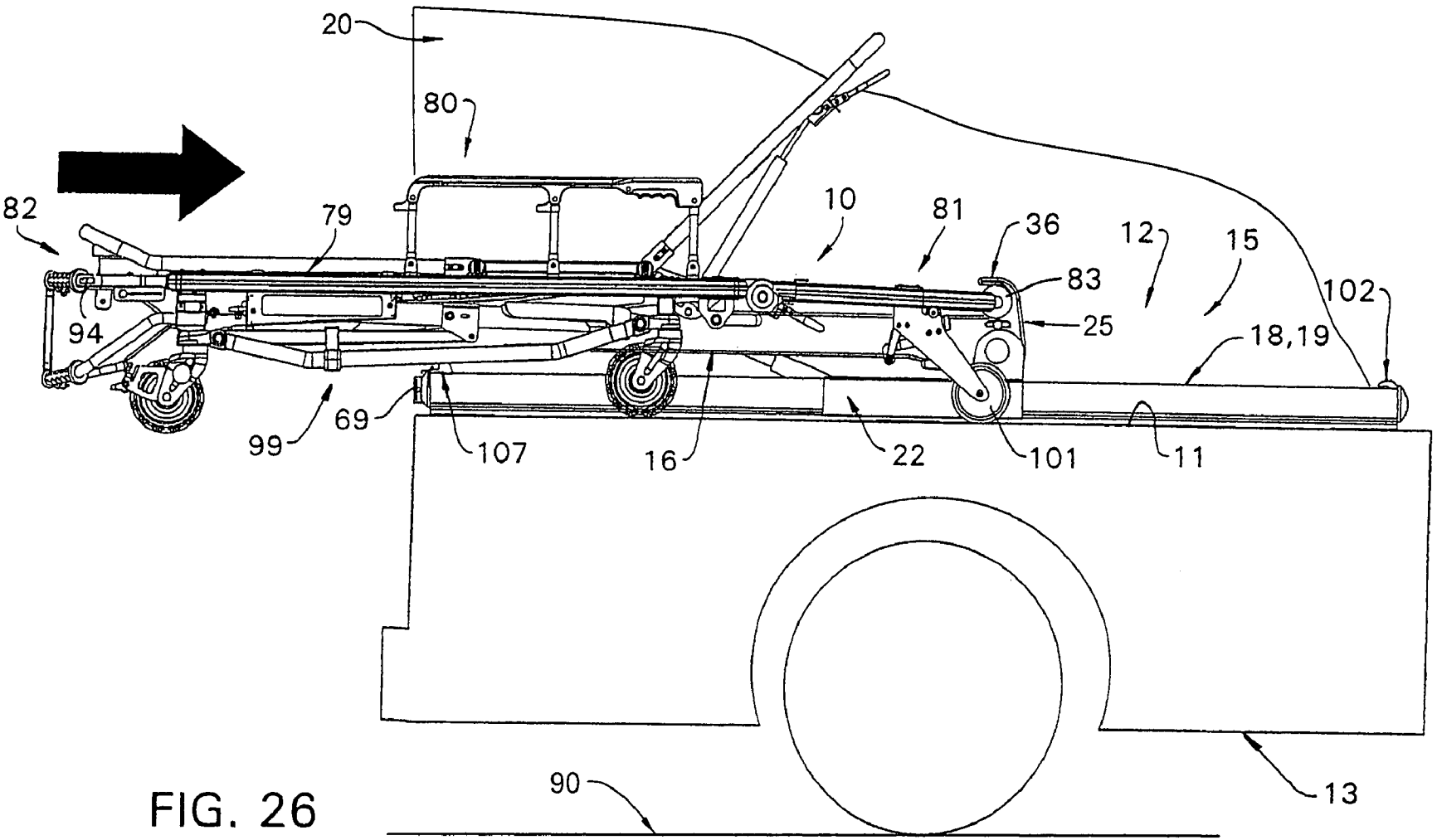
FIG. 26 is a view similar to FIG. 25, but with the ambulance cot and trolley moved partially into the cargo area of the ambulance.
Figure 27:
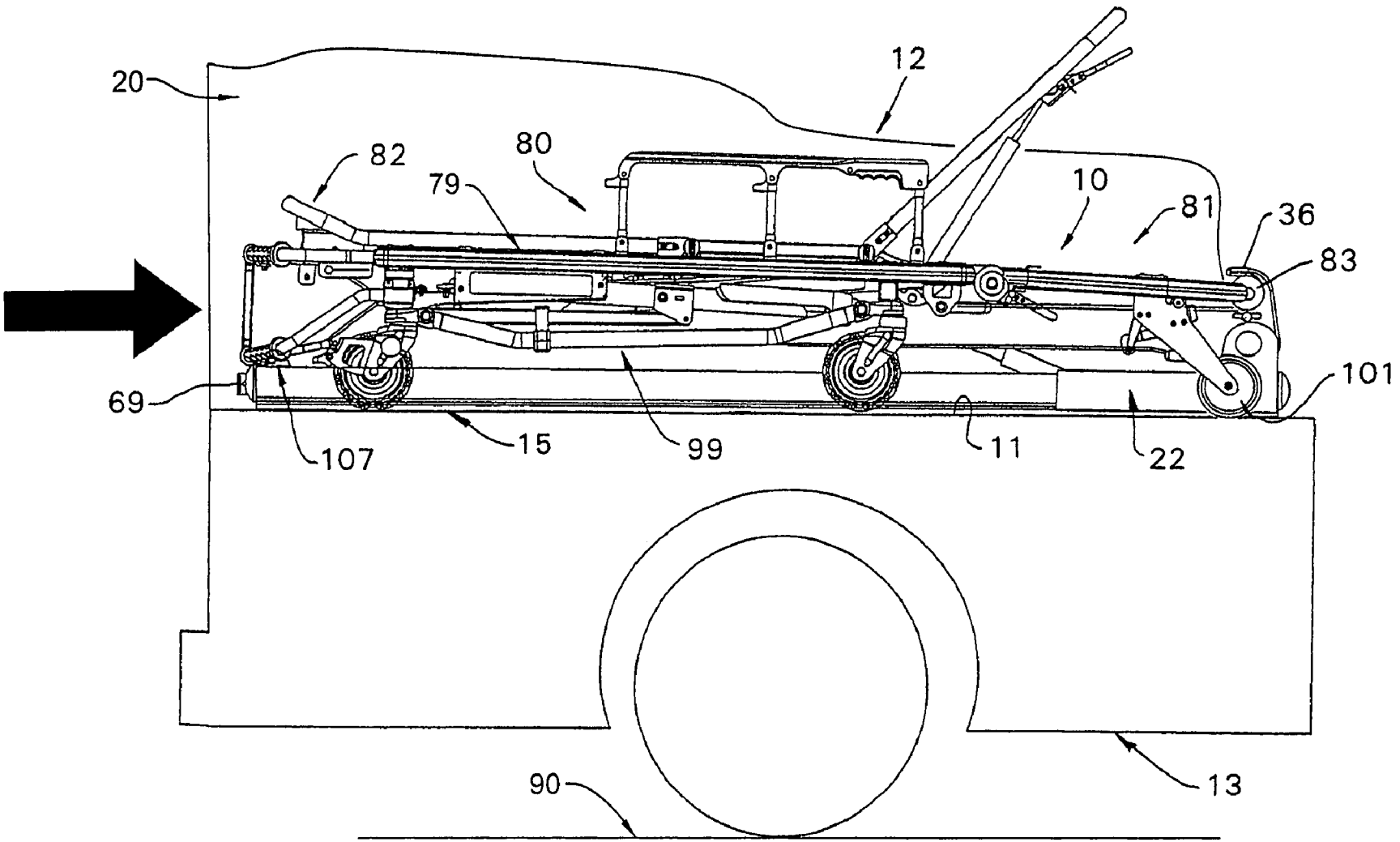
FIG. 27 is a view similar to FIG. 26, but with the trolley and the ambulance cot inserted fully into the interior of the cargo area of the ambulance.

Next, the ambulance cot 80 is moved by the attendant and on its wheel supported base 99 until the roller 83 at the head end patient support frame 79 of the ambulance cot engages the inclined upper surface of the elongate boom 16 and rolls into the interior 37 of the hook-like configuration 36 of the docking structure 25. At this point in time, the lead support wheel 101 moves into engagement and rests on the floor surface 11 of the cargo area 12 of the ambulance 13 as depicted in FIG. 23. As the roller 83 enters the interior 37 of the hook-like configuration 36, the sets of toggle levers 38 and 39 will be moved clockwise from the position illustrated in FIG. 17 to a position wherein the long legs 41 (FIG. 17) become upright to effect a holding of the roller 83 into the interior space 37 of the hook-like configuration 36. The latch 42 will be received in a notch 43 to hold the toggle levers 39 in the locked position whereat the long leg 41 extends in a vertically upright manner. At this point in time, the ambulance cot 80 is now locked at the head end 81 thereof to the ambulance cot loading and unloading device 10. In addition, the roller 83 has depressed the object detector 66 inside the interior 37 of the hook-like configuration to effect a raising through the linkage 67 of the locking pin 61. The toggle lever switch 94 is next operated to change its state from a "neutral" state (FIG. 18) to a "retract base" state to effect a battery powered operation of the motor 97 to effect a contracting of the base 99 as depicted in FIG. 24. Since the spacing between the hook-like configuration 36 and the depression 47 of the docking structure 25 on the elongate boom 16 is equal to the spacing between the roller 83 and the connection piece 87 on the cot 80 as the base 99 retracts, the ambulance cot 80 will initially be lowered about a pivot axis defined by the roller 83 received in the hook-like configuration 36 until the connection piece 87 is received in the depression 47 in the elongate boom 16 so that the sets of contacts 88 and 48 come into contact with each other. At this moment, the "retract base" state of the toggle switch 94 usurps the toggle switch 51 so that the toggle switch 94 in the "retract base" position effects an extension of the jack mechanism 49 and thence a raising of the elongate boom 16 from the FIG. 24 position to the FIG. 25 position. The toggle switch 94 remains in the "retract base" condition until the base 99 is fully collapsed and all six wheels on the ambulance cot 80 are aligned with the floor 11 in the cargo area 12 of the ambulance 13. Thereafter, the attendant can simply push on the foot end 82 of the ambulance cot 80 to facilitate movement of the ambulance cot 80 and the interconnected trolley 22 through the position illustrated in FIG. 26 to the position illustrated in FIG. 27. During this transitional movement, the electrical contacts 56 and 60 become disconnected and when the trolley 22 reaches the position illustrated in FIG. 27, the electrical contacts 32 and 33 will interconnect so that the battery 98 onboard the ambulance cot 80 will be recharged by the electrical system onboard the ambulance 13 and through the electrical connection provided by the interconnected set of contacts 48 and 88. As the trolley 22 moves toward its final location illustrated in FIG. 27, the locking bar 27 (FIG. 12) will be operatively received in a trolley locking mechanism 102. The trolley locking mechanism 102 consists of a pair of laterally spaced hook-like configurations 103 which each include an interior space 104 facilitating reception of the locking bar 27 on the trolley 22. A toggle lever 106 is associated with each hook-like configuration 103 and rotate against the urging of a not illustrated torsion spring so that the horizontal leg illustrated in FIG. 12 will be shifted to a vertically upright position to hold the locking bar 27 in place. The change in state of the toggle levers 106 is illustrated in FIGS. 14, 15 and 16.

Next, the ambulance cot 80 is moved by the attendant and on its wheel supported base 99 until the roller at the head end of the ambulance cot engages the inclined upper surface of the elongate boom 16 and rolls into the interior 37 of the hook-like configuration 36. At this point in time, the lead support wheel 101 moves into engagement and rests on the floor surface 11 of the cargo area 12 of the ambulance 13 as depicted in FIG. 23. As the roller 83 enters the interior 37 of the hook-like configuration 36, the sets of toggle levers 38 and 39 will be moved clockwise from the position illustrated in FIG. 17 to a position wherein the long legs 41 (FIG. 17) become upright to effect a holding of the roller 83 into the interior space 37 of the hook-like configuration 36. The latch 42 will be received in a notch 43 to hold the toggle levers 39 in the locked position whereat the long leg 41 extends in a vertically upright manner. At this point in time, the ambulance cot 80 is now locked at the head end 81 thereof to the ambulance cot loading and unloading device 10. In addition, the roller 83 has depressed the object detector 66 inside the interior 37 of the hook-like configuration to effect a raising through the linkage 67 of the locking pin 61. The toggle lever switch 94 is next operated to change its state from a "neutral" state (FIG. 18) to a "retract base" state to effect a battery powered operation of the motor 97 to effect a contracting of the base 99 as depicted in FIG. 24. Since the spacing between the hook-like configuration 36 and the depression 47 on the elongate boom 16 is equal to the spacing between the roller 83 and the connection piece 87 on the cot 80 as the base 99 retracts, the ambulance cot 80 will initially be lowered about a pivot axis defined by the roller 83 received in the hook-like configuration 36 until the connection piece 87 is received in the depression 47 in the elongate boom 16 so that the sets of contacts 88 and 48 come into contact with each other. At this moment, the "retract base" state of the toggle switch 94 usurps the toggle switch 51 so that the toggle switch 94 in the "retract base" position effects an extension of the jack mechanism 49 and thence a raising of the elongate boom 16 from the FIG. 24 position to the FIG. 25 position. The toggle switch 94 remains in the "retract base" condition until the base 99 is fully collapsed and all six wheels on the ambulance cot 80 are aligned with the floor 11 in the cargo area 12 of the ambulance 13. Thereafter, the attendant can simply push on the foot end 82 of the ambulance cot 80 to facilitate movement of the ambulance cot 80 and the interconnected trolley 22 through the position illustrated in FIG. 26 to the position illustrated in FIG. 27. During this transitional movement, the electrical contacts 56 and 60 become disconnected and when the trolley 22 reaches the position illustrated in FIG. 27, the electrical contacts 32 and 33 will interconnect so that the battery 98 onboard the ambulance cot 80 will be recharged by the electrical system onboard the ambulance 13 and through the electrical connection provided by the interconnected set of contacts 48 and 88. As the trolley 22 moves toward its final location illustrated in FIG. 27, the locking bar 27 (FIG. 12) will be operatively received in a trolley locking mechanism 102. The trolley locking mechanism 102 consists of a pair of laterally spaced hook-like configurations 103 which each include an interior space 104 facilitating reception of the locking bar 27 on the trolley 22. A toggle lever 106 is associated with each hook-like configuration 103 and rotate against the urging of a not illustrated torsion spring so that the horizontal leg illustrated in FIG. 12 will be shifted to a vertically upright position to hold the locking bar 27 in place. The change in state of the toggle levers 106 is illustrated in FIGS. 14, 15 and 16.

Figure 30:
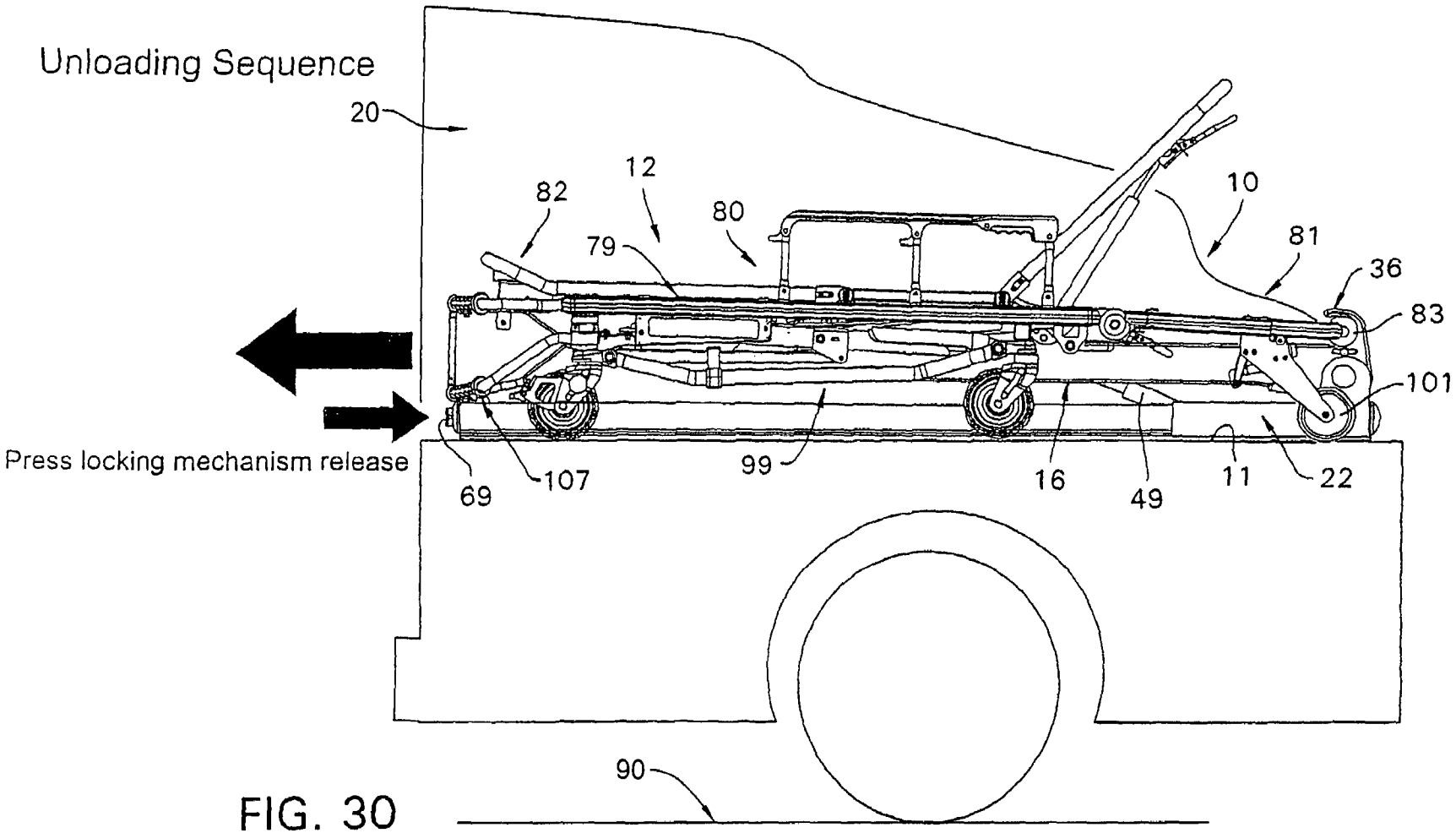
FIG. 30 is a side view illustrating the starting of an unloading sequence.
Figure 31:
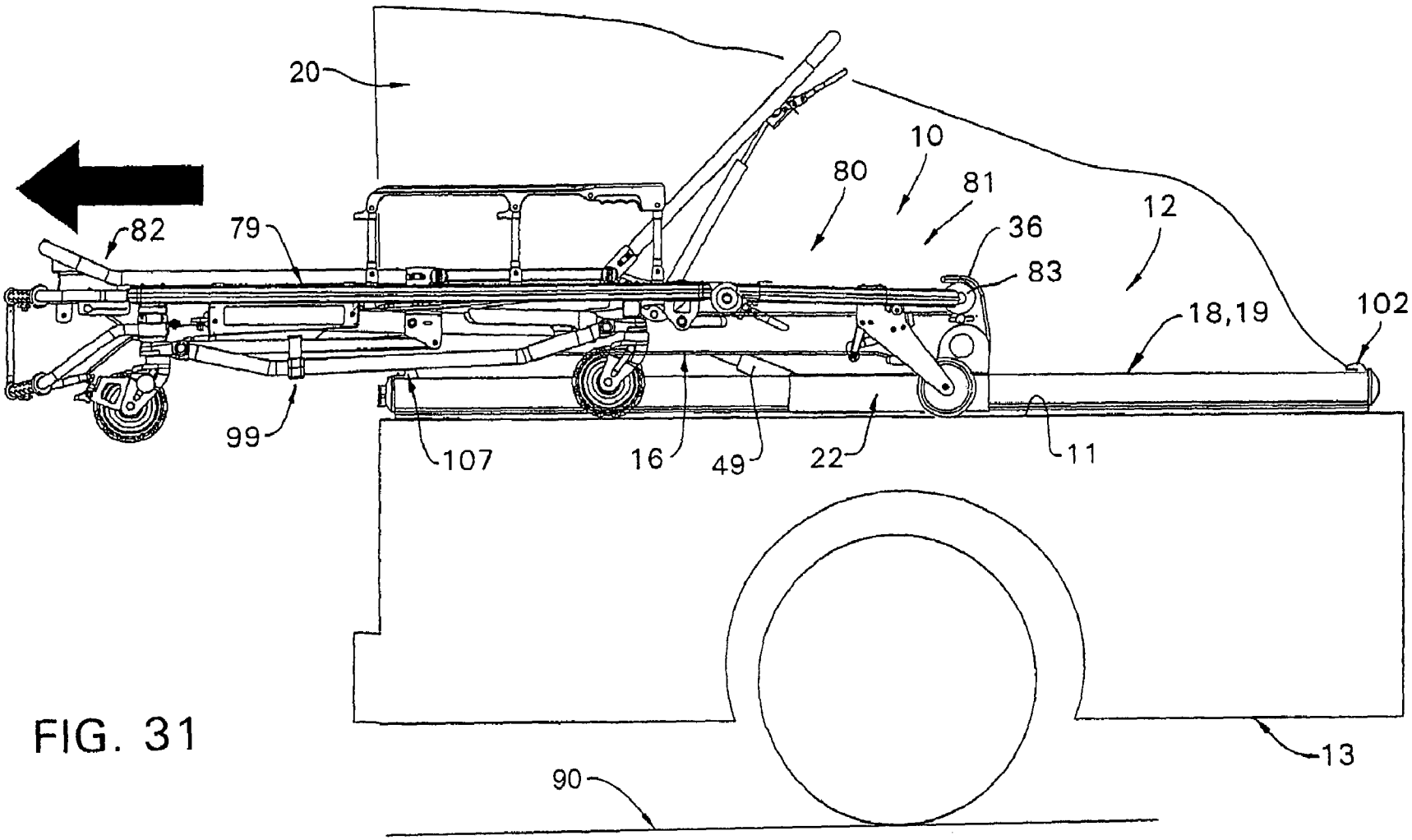
FIG. 31 is a view similar to FIG. 30, but with the ambulance cot having partially exited the cargo area.
Figure 32:
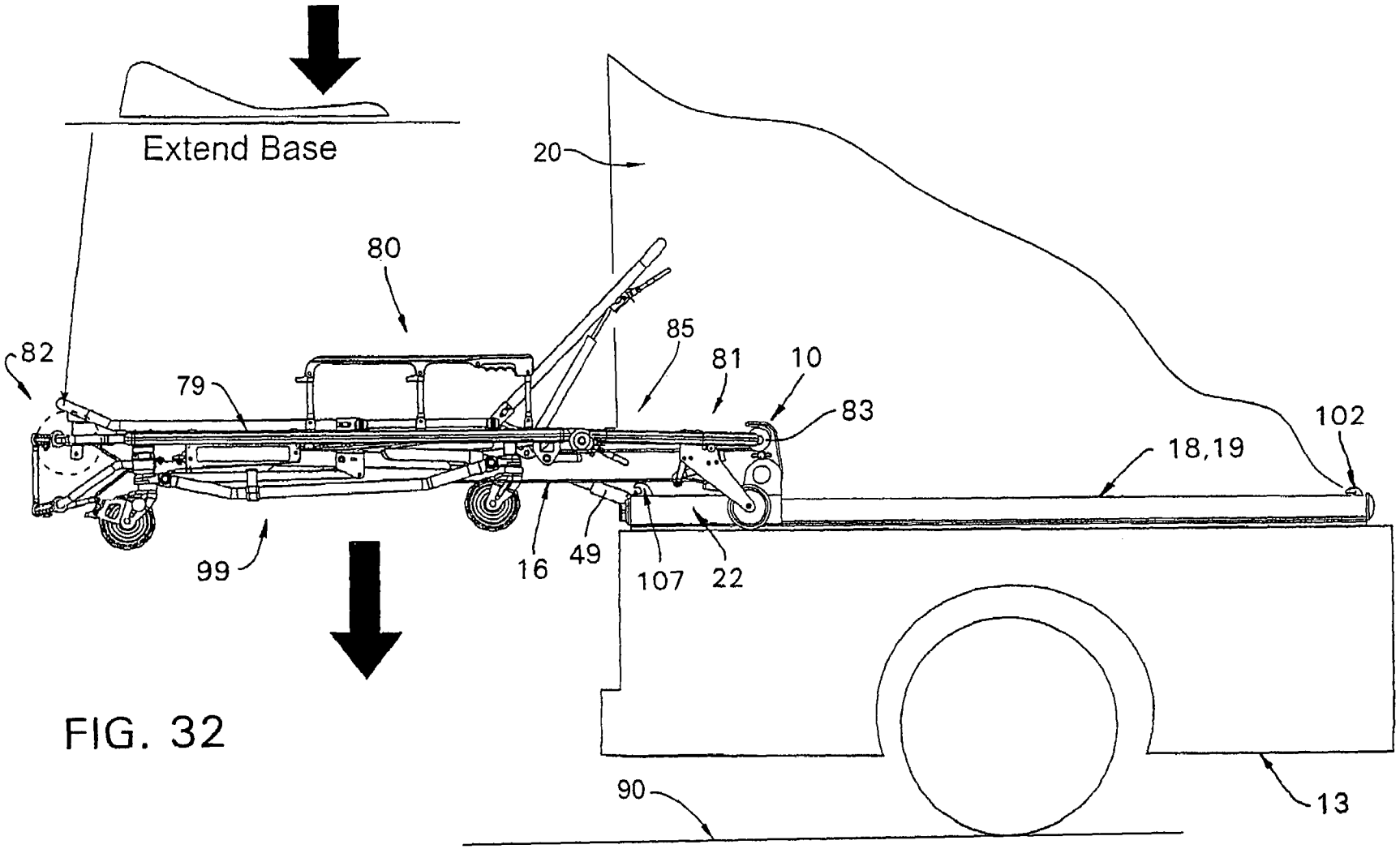
FIG. 32 is a view similar to FIG. 31, but with the base portion of the ambulance cot oriented above the ground surface.
Figure 33:
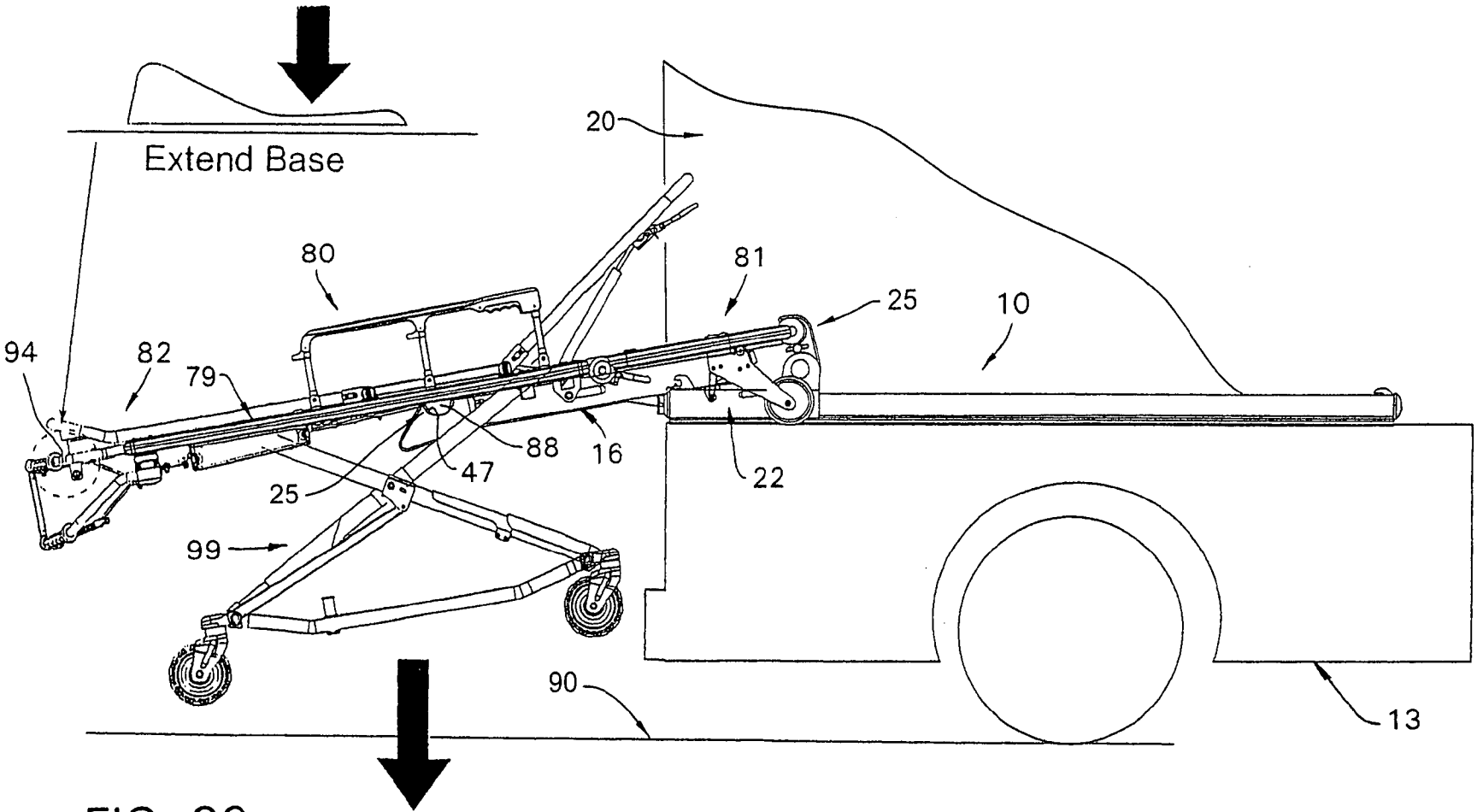
FIG. 33 is a view similar to FIG. 32, but with the base of the ambulance cot partially extended.
Figure 34:
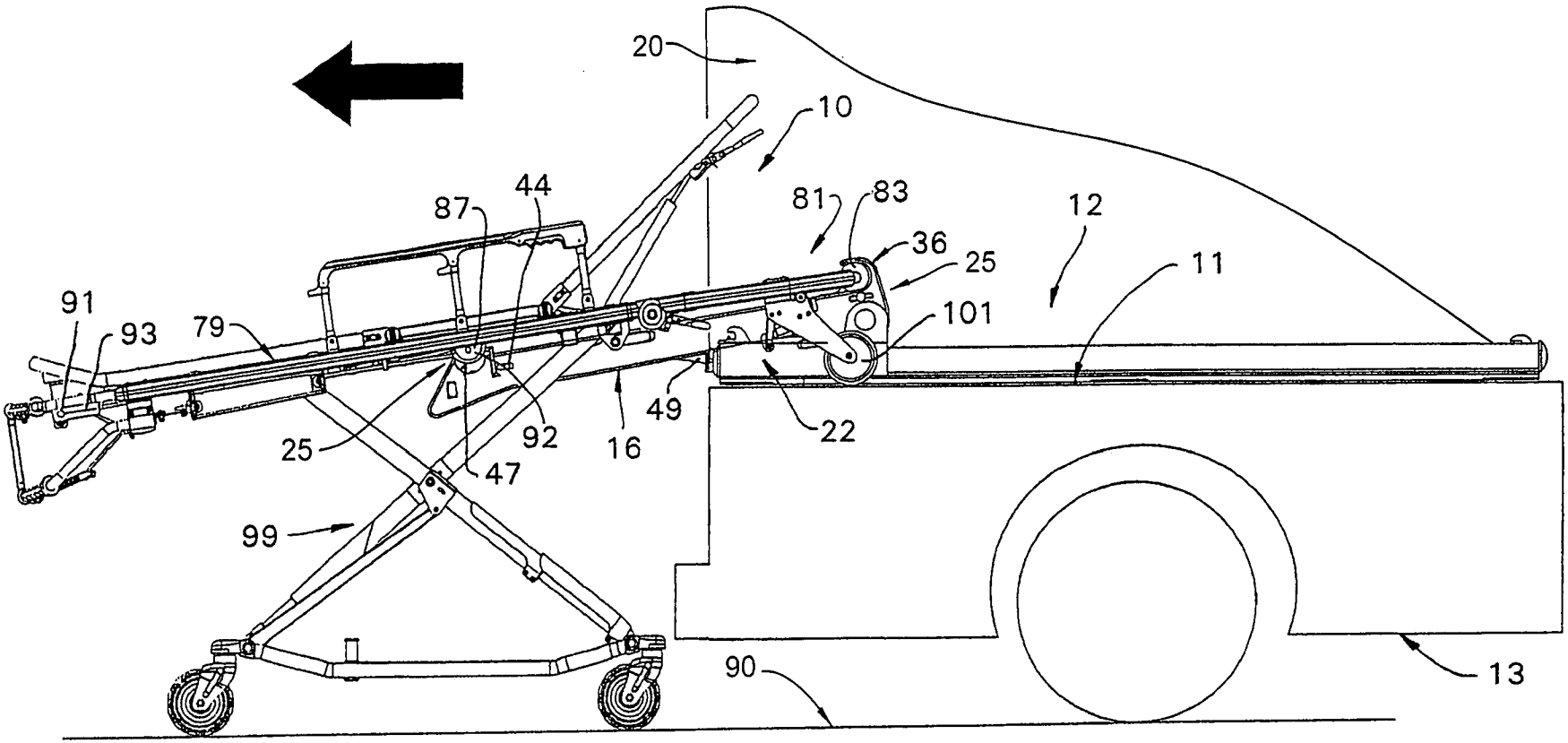
FIG. 34 is a view similar to FIG. 33, but with the base of the ambulance cot fully extended so that the wheels thereof are supported on the ground surface.

Referring now to FIG. 30, when it is desired to remove the ambulance cot 80 from the cargo area 12 of the ambulance 13 through the access opening 20, the handle 69 is pushed forwardly against the force of the not illustrated centering spring as depicted in FIGS. 14, 15 and 16 to cause the elongate rod 71 to unlatch the latches 108 to cause the torsion springs to move the toggle levers 106 from the FIG. 15 position to the FIGS. 14 and 16 positions to thereby release the lift bar 84 and the locking bar 27 therefrom. Thereafter, the attendant can pull on the lift bar 84 or the handles 86 at the foot end 82 of the ambulance cot 80 to effect a movement of not only the ambulance cot 80 but also the trolley 22 from the position illustrated in FIG. 30 through the position illustrated in FIG. 31 to the position illustrated in FIG. 32 to provide a cantilever support, as at 85, of the ambulance cot which extends externally away from the access opening 20 such that the wheel supported base 99 on the ambulance cot is spaced directly above the ground surface 90 unobstructed by other structures. In this position, the set of contacts 56 and 60 reengage so that battery power from the battery 98 onboard the ambulance cot is interconnected to the toggle switch 94 onboard the ambulance cot to thereby enable the attendant to manipulate the switch to the "extend base" position to operatively simultaneously cause the jack mechanism 49 to be operated to retract and lower the elongate boom 16 from the position illustrated in FIG. 32 to the position illustrated in FIG. 33 and an extension of the base 99 from its fully retracted position illustrated in FIG. 32 and as depicted in FIG. 33. Even though the elongate boom 16 has reached its lowermost position as depicted in FIG. 33, the attendant's continued operation of the toggle switch 94 by holding it in its "extend base" state, the wheel supported base 99 will continue to extend until all four wheels are in engagement with the ground surface 90 as illustrated in FIG. 34 and the connection piece 87 is raised out of the depression 47 of the docking structure 25 in the elongate boom 16 to decouple the electrical contacts 48 and 88. At this point in the ambulance cot 80 removal sequence, the wheels 101 at the head end 81 of the ambulance cot 80 are still in engagement with the floor 11 of the cargo area 12 of the ambulance 13 and as depicted in FIG. 34. Thereafter, the handle 91 at the foot end 82 of the ambulance cot 80 is slid forwardly in the elongate slot 93 so that the abutment 92 interconnected therewith will abut the handle 44 on the elongate boom 44 to effect an unlatching of the set of toggle levers 38, 39 of the docking structure 25 to release the roller 83 from the hook-like configuration 36 on the trolley 22. In the alternative, the handle 45 can be manually manipulated to free the ambulance cot 80 from the trolley 22.

Referring now to FIG. 30, when it is desired to remove the ambulance cot 80 from the cargo area 12 of the ambulance 13, the handle 69 is pushed forwardly against the force of the not illustrated centering spring as depicted in FIGS. 14, 15 and 16 to cause the elongate rod 71 to unlatch the latches 108 to cause the torsion springs to move the toggle levers 106 from the FIG. 15 position to the FIGS. 14 and 16 positions to thereby release the lift bar 84 and the locking bar 27 therefrom. Thereafter, the attendant can pull on the lift bar 84 or the handles 86 at the foot end 82 of the ambulance cot 80 to effect a movement of not only the ambulance cot 80 but also the trolley 22 from the position illustrated in FIG. 30 through the position illustrated in FIG. 31 to the position illustrated in FIG. 32. In this position, the set of contacts 56 and 60 reengage so that battery power from the battery 98 onboard the ambulance cot is interconnected to the toggle switch 94 onboard the ambulance cot to thereby enable the attendant to manipulate the switch to the "extend base" position to operatively simultaneously cause the jack mechanism 49 to be operated to retract and lower the elongate boom 16 from the position illustrated in FIG. 32 to the position illustrated in FIG. 33 and an extension of the base 99 from its fully retracted position illustrated in FIG. 32 and as depicted in FIG. 33. Even though the elongate boom 16 has reached its lowermost position as depicted in FIG. 33, the attendant's continued operation of the toggle switch 94 by holding it in its "extend base" state, the base 99 will continue to extend until all four wheels are in engagement with the ground as illustrated in FIG. 34 and the connection piece 87 is raised out of the depression 47 in the elongate boom 16 to decouple the electrical contacts 48 and 88. At this point in the ambulance cot 80 removal sequence, the wheels 101 at the head end 81 of the ambulance cot 80 are still in engagement with the floor 11 of the cargo area 12 of the ambulance 13 and as depicted in FIG. 34. Thereafter, the handle 91 at the foot end 82 of the ambulance cot 80 is slid forwardly in the elongate slot 93 so that the abutment 92 interconnected therewith will abut the handle 44 on the elongate boom 16 to effect an unlatching of the set of toggle levers 38, 39 to release the roller 83 from the hook-like configuration 36 on the trolley 22. In the alternative, the handle 45 can be manually manipulated to free the ambulance cot 80 from the trolley 22.

Figure 35:
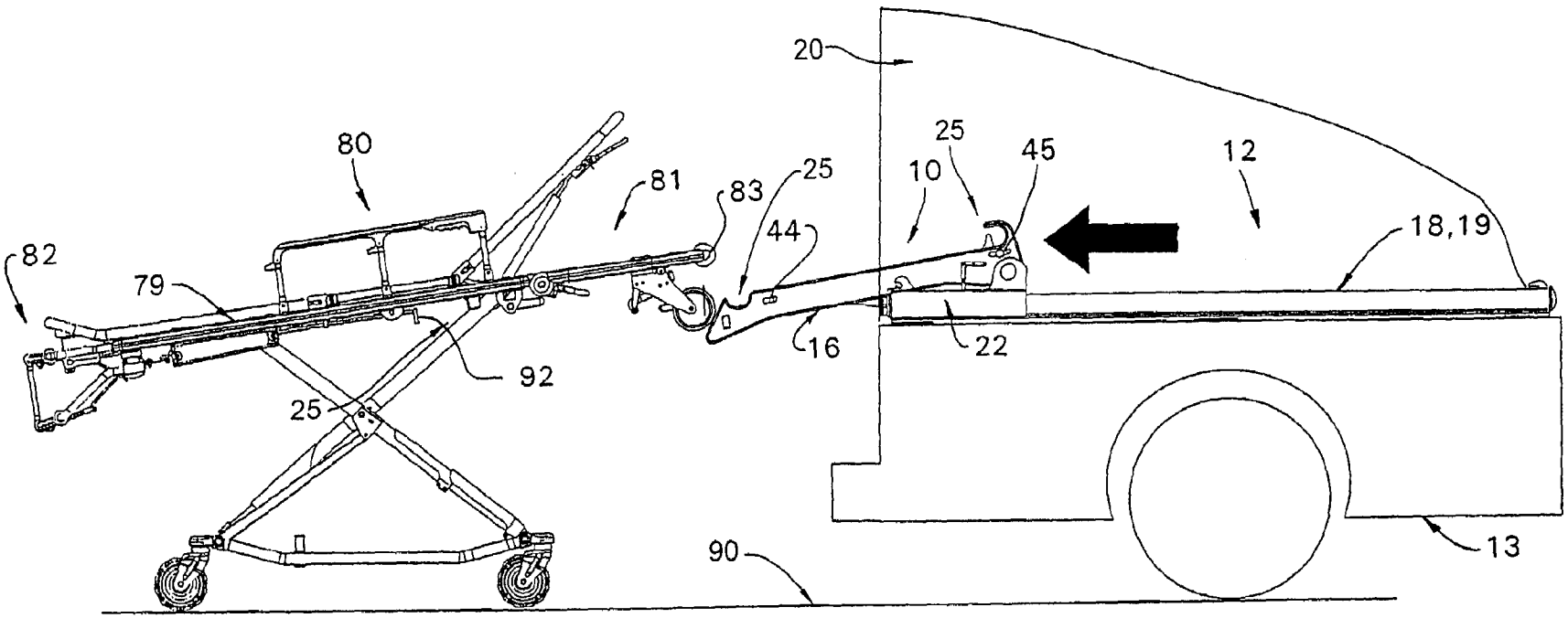
FIG. 35 is a view similar to FIG. 34, but with the ambulance cot separated from the ambulance cot loading and unloading mechanism.

The ambulance cot 80 is now freed from the ambulance cot loading and unloading device 10 and is capable of moving freely away from the ambulance on the wheel supported base 99 as depicted in FIG. 35.

Although a particular preferred embodiment of the invention has been disclosed in detail for illustrative purposes, it will be recognized that variations or modifications of the disclosed apparatus, including the rearrangement of parts, lie within the scope of the present invention. For example, all or selected ones of the electrical contacts could be replaced with electrical devices, such as proximity type switches or radio frequency activated devices where actual contact between components is not required in order to effect the desired electrical communication. Additionally, during loading, the boom and cot can be lifted before the base is collapsed. Similarly, during unloading, the base can be fully deployed before the boom is lowered.

What is claimed is:

1. A method of loading a wheel supported ambulance cot having a collapsible and extendable base thereon through an access opening into a cargo area of an ambulance, comprising the steps of:

deploying a trolley to a load position;

moving said ambulance cot toward and into coupled engagement with said trolley, said trolley being additionally configured to effect a cantilevered support of said ambulance cot externally away from said access opening such that the wheel supported base on said ambulance cot is spaced directly above a ground surface unobstructed by other structure;

collapsing said base to effect said ambulance cot being supported entirely on said trolley; and moving said trolley and ambulance cot coupled thereto into said cargo area of said ambulance.

2. The method according to claim 1, wherein said deploying step includes the step of deploying said trolley to a load position spaced vertically above a ground surface on which said ambulance is supported and the step of tilting an elongate boom on said trolley from a position parallel to the floor surface of said cargo area downwardly toward the ground surface.

3. The method according to claim 2, wherein said collapsing step additionally includes the step of raising the elongate boom (16) to the position above the floor surface of said cargo area and with said ambulance cot coupled thereto.

4. The method according to claim 3, wherein said raising step and said base collapsing step occur simultaneously after said wheels disengage from the ground surface.

* * * * *